US010233049B2

(12) United States Patent
Kim et al.

(10) Patent No.: US 10,233,049 B2
(45) Date of Patent: Mar. 19, 2019

(54) FINANCIAL DEVICE AND METHOD FOR CONTROLLING THE SAME

(71) Applicant: ATEC AP CO., LTD., Seongnam-si, Gyeonggi-do (KR)

(72) Inventors: Jae Yong Kim, Seoul (KR); Jong Kwang Kim, Seoul (KR); Yoon Seok Choi, Seoul (KR); Do Yeon Kim, Seoul (KR); Chang Ho Moon, Seoul (KR); Sung Woo Lee, Seoul (KR)

(73) Assignee: LG CNS CO., LTD, Seoul (KR)

( * ) Notice: Subject to any disclaimer, the term of this patent is extended or adjusted under 35 U.S.C. 154(b) by 0 days.

(21) Appl. No.: 15/597,590

(22) Filed: May 17, 2017

(65) Prior Publication Data

US 2017/0334675 A1 Nov. 23, 2017

(30) Foreign Application Priority Data

May 17, 2016 (KR) ..... 10-2016-0060352
Aug. 18, 2016 (KR) ..... 10-2016-0104695
Oct. 6, 2016 (KR) ..... 10-2016-0129121

(51) Int. Cl.
*G07D 11/00* (2006.01)
*B65H 31/20* (2006.01)
(Continued)

(52) U.S. Cl.
CPC ..... *B65H 43/02* (2013.01); *B65H 3/06* (2013.01); *B65H 3/44* (2013.01); *B65H 29/22* (2013.01);
(Continued)

(58) Field of Classification Search
CPC ..... B65H 31/20; B65H 31/24; B65H 3/44; B65H 2701/1912; B65H 1/04;
(Continued)

(56) References Cited

U.S. PATENT DOCUMENTS 6,773,009 B2 * 8/2004 So ..... B65H 3/0669 271/10.13
6,889,897 B2 * 5/2005 Nomiyama ..... G07D 11/0012 235/379
(Continued)

FOREIGN PATENT DOCUMENTS

DE 102010004580 A1 7/2011
EP 1326215 A2 7/2003
(Continued)

OTHER PUBLICATIONS

Office Action of Korean Patent Office in Appl'n No. 10-2016-0104695, dated Jul. 20, 2017.
(Continued)

*Primary Examiner* — Luis A Gonzalez
(74) *Attorney, Agent, or Firm* — Dentons US LLP

(57) ABSTRACT

Disclosed herein are a financial device and a method for controlling the same. The financial device includes: a multi-media storage module including a first storage part having a first stacking space in which media are stacked and a second storage part disposed under the first storage part and having a second stacking space in which media are stacked, in which the multi-media storage module has the first stacking space and the second stacking space provided at different sizes.

10 Claims, 25 Drawing Sheets

(51) Int. Cl.

| | |
|---|---|
| ***B65H 31/24*** | (2006.01) |
| ***B65H 1/04*** | (2006.01) |
| ***B65H 3/44*** | (2006.01) |
| ***B65H 43/02*** | (2006.01) |
| ***B65H 3/06*** | (2006.01) |
| ***B65H 29/22*** | (2006.01) |
| ***B65H 31/34*** | (2006.01) |

(52) U.S. Cl.
CPC ..... *B65H 31/20* (2013.01); *B65H 31/24* (2013.01); *B65H 31/34* (2013.01); *G07D 11/0006* (2013.01); *G07D 11/0012* (2013.01); *G07D 11/0018* (2013.01); *G07D 11/0021* (2013.01); *G07D 11/0081* (2013.01); *B65H 2405/332* (2013.01); *B65H 2701/1912* (2013.01)

(58) Field of Classification Search
CPC ..... B65H 1/266; B65H 2405/332; G07D 11/0012; G07D 11/0018; G07D 11/0021; G07D 11/0006; G07D 11/0081
See application file for complete search history.

(56) References Cited

U.S. PATENT DOCUMENTS

| | | | | |
|---|---|---|---|---|
| 7,938,274 | B2 * | 5/2011 | Yui | B65H 31/18 209/534 |
| 7,976,005 | B2 * | 7/2011 | Ichikawa | B65H 31/24 271/3.01 |
| 9,067,745 | B2 * | 6/2015 | Komatsu | B65H 31/10 |
| 9,352,925 | B2 * | 5/2016 | Komatsu | B65H 31/20 |
| 2002/0014736 | A1 * | 2/2002 | Katou | B65H 1/025 271/126 |
| 2003/0127509 | A1 | 7/2003 | Nomiyama et al. | |
| 2004/0256784 | A1 | 12/2004 | Nomiyama et al. | |
| 2007/0182090 | A1 | 8/2007 | Gerlier et al. | |
| 2009/0152799 | A1 * | 6/2009 | Cha | B65H 1/025 271/18 |
| 2010/0294834 | A1 | 9/2010 | Wong | |
| 2011/0226581 | A1 | 9/2011 | Cha et al. | |
| 2013/0140756 | A1 * | 6/2013 | Kim | B65H 3/06 271/9.08 |
| 2015/0371507 | A1 | 12/2015 | Moon | |
| 2015/0379797 | A1 | 12/2015 | Lee et al. | |
| 2016/0101953 | A1 * | 4/2016 | Suetaka | B65H 3/5215 271/10.11 |

FOREIGN PATENT DOCUMENTS

| | | | | |
|---|---|---|---|---|
| EP | 1489563 | A1 | 12/2004 | |
| JP | 2000187752 | A * | 7/2000 | B65H 83/025 |
| JP | 2008-084164 | A | 4/2008 | |
| JP | 2010-267300 | A | 11/2010 | |
| JP | 2013-140620 | A | 7/2013 | |
| KR | 2011-0078266 | A | 7/2011 | |
| KR | 10-1250657 | B | 4/2013 | |
| KR | 20130061879 | A | 6/2013 | |
| KR | 2013-0088660 | A | 8/2013 | |
| KR | 10-2015-0054080 | A | 5/2015 | |
| KR | 10-2016-0002284 | A | 1/2016 | |
| KR | 2016-0000188 | A | 1/2016 | |
| KR | 2016-0006014 | A | 1/2016 | |
| KR | 2016-0066166 | A | 6/2016 | |
| RU | 2525741 | C2 | 8/2014 | |

OTHER PUBLICATIONS

Notice of Allowance issued by the Korean Patent Office in Appl'n No. 10-2016-0129121, dated Sep. 12, 2017.

* cited by examiner

FINANCIAL DEVICE AND METHOD FOR CONTROLLING THE SAME

CROSS-REFERENCE TO RELATED APPLICATION

This application is based on and claims the benefit of priority to Korean Patent Application No. 10-2016-0060352, filed on May 17, 2016 and Korean Patent Application No. 10-2016-0129121, filed on Oct. 6, 2016 and Korean Patent Application No. 10-2016-0104695, filed on Aug. 18, 2016 in the Korean Intellectual Property Office, the disclosure of which is incorporated herein in its entirety by reference.

TECHNICAL FIELD

The present disclosure relates to a financial device and a method for controlling the same.

BACKGROUND

A financial device for processing financial businesses includes a media storage device for storing media that are inserted into the financial device. A wide variety of media are used for the financial businesses, and each media may have a different size.

The existing financial device may have a problem in that a stacked state of media is poor while various sizes of media are inserted into and withdrawn from the media storage device in which the media are stored and therefore the media are not normally separated or a jam occurs.

Further, in order to prevent the above problems, the number of media storage devices needs to be increased to cope with the size of each media. In this case, there is a problem in that the overall size of the financial device is getting larger.

SUMMARY

The present disclosure has been made to solve the above-mentioned problems occurring in the prior art while advantages achieved by the prior art are maintained intact.

An aspect of the present disclosure provides a media storage module capable of accommodating various sizes of media.

Another aspect of the present disclosure provides a financial device using a media storage module capable of accommodating various sizes of media as a temporary stacking device for temporarily storing media.

Still another aspect of the present disclosure provides a financial device using a media storage module capable of accommodating various sizes of media in performing ready-money verification.

Yet another aspect of the present disclosure provides a media storage device capable of improving a transportation quality of media and increasing the number of media storage devices mounted in a financial device by efficiently performing a space disposition inside the media storage device including a plurality of media stacking spaces, and a financial device including the same.

Still yet another aspect of the present disclosure provides media processing device capable of smoothly performing deposit and withdrawal in a plurality of media stacking spaces.

According to an exemplary embodiment of the present disclosure, a financial device includes: a multi-media storage module including a first storage part having a first stacking space in which media are stacked and a second storage part disposed under the first storage part and having a second stacking space in which media are stacked, in which the multi-media storage module has the first stacking space and the second stacking space provided at different sizes.

According to another exemplary embodiment of the present disclosure, a method for controlling a financial device including a multi-media storage module including a first storage part having a first stacking space in which media are stacked and a second storage part disposed under the first storage part and having a second stacking space having media stacked therein and having a size different from that of the first stacking space, the method includes: a transporting step of transporting the media to stack the media in the multi-media storage module or withdraw the media from the multi-media storage module; a identifying step of identifying denominations of the media transported in the transporting step; and a stacking step of transporting the media to any one of the first stacking space and the second stacking space based on a size of the media identified in the identifying step.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
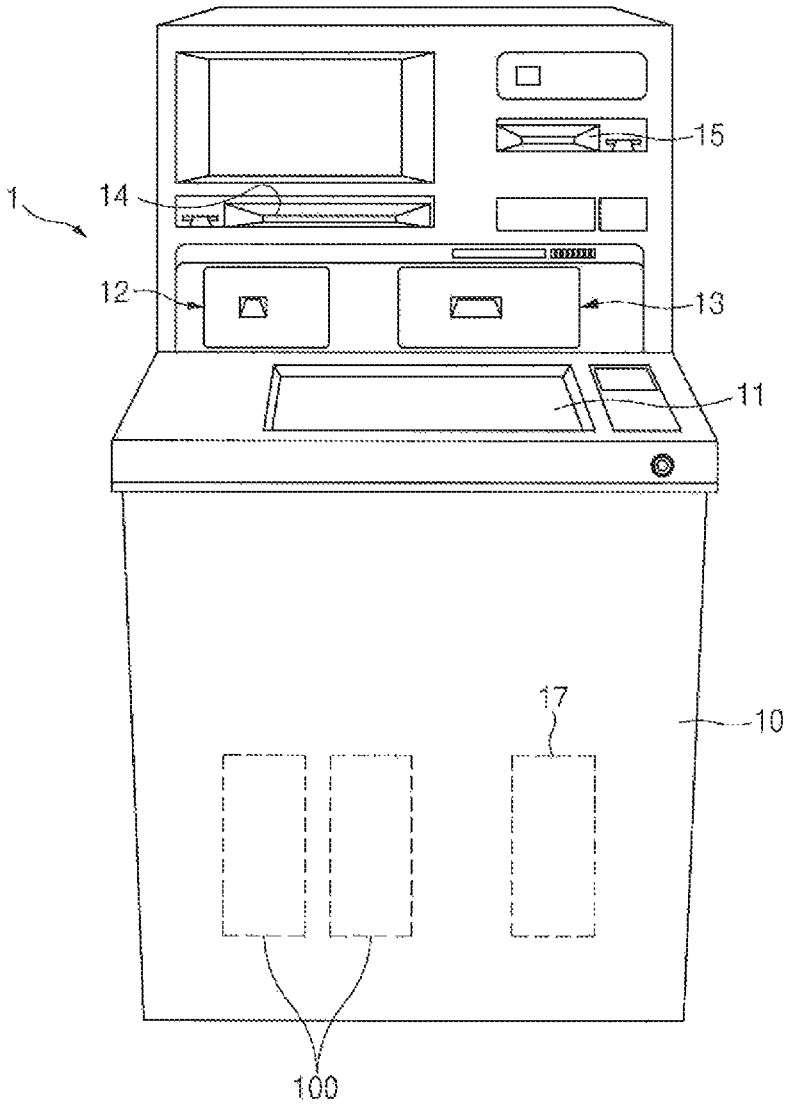
FIG. 1 is a perspective view showing a financial device according to an embodiment of the present disclosure.

Hereinafter, exemplary embodiments of the present disclosure will be described with reference to the accompanying drawings. It is to be noted that in giving reference numerals to components of each of the accompanying drawings, the same components will be denoted by the same reference numerals even though they are shown in different drawings. Further, in describing exemplary embodiments of the present disclosure, well-known constructions or functions will not be described in detail in the case in which it is decided that they may unnecessarily obscure the understanding of the present disclosure.

In addition, in describing components of exemplary embodiments of the present disclosure, terms such as first, second, A, B, (a), (b), etc. can be used. These terms are used only to differentiate the components from other components. Therefore, the nature, times, sequence, etc. of the corresponding components are not limited by these terms. When any components are "connected", "coupled", or "linked" to other components, it is to be noted that the components may be directly connected or linked to other components, but the components may be "connected", "coupled", or "linked" to other components via another component therebetween.

A financial device according to an exemplary embodiment of the present disclosure is a device which receives various media such as a banknote, securities, a giro, a coin, and a gift certificate to execute media processing such as processings like deposit processing, giro receipt, and gift certificate exchange, etc., and/or processings like withdrawal processing, a giro release, a gift certificate release, etc., to thereby execute financial businesses. An example of the financial device may include an automatic teller machine (ATM) such as a cash dispenser (CD) and a cash recycling device. However, the financial device is not limited to the foregoing example, and therefore may be an apparatus for automating financial businesses like a financial information system (FIS).

Hereinafter, an embodiment of the present disclosure will be described under the assumption that the financial device is an automatic teller machine. However, the assumption is only for convenience of explanation, and the technical idea of the present disclosure is not limited to the automatic teller machine.

FIG. 1 is a perspective view schematically showing a financial device according to an exemplary embodiment of the present disclosure.

Referring to FIG. 1, a financial device 1 according to an embodiment of the present disclosure may include a media processing device for processing media.

The financial device 1 may further include a customer information acquiring unit for acquiring customer information.

The customer information acquiring unit may include a passbook processing module 14 for enabling a passbook to be inserted and withdrawn and recognizing the passbook. Alternatively, the customer information acquiring unit may include a card processing module 15 for enabling a card to be inserted/withdrawn and recognizing the card.

There is no limitation on a type of customer information acquiring units, and it is also possible to acquire information recorded in short distance communication, an RFID tag, or an USB, or acquire customer information using biometric information such as a fingerprint.

The financial device 1 may further include a user interface 11 capable of displaying a menu and information for deposit or withdrawal and inputting or selecting a command or information for deposit or withdrawal.

The financial device 1 may further include a controller 17 capable of controlling the media processing device, the customer information acquiring unit or the user interface 11 of the financial device, or the like. In this case, the controller may include a media processing device controller for controlling the media processing device, and a financial device controller for controlling the financial device.

The media processing device may include an upper module and a lower module. The upper module may be removably connected to the lower module or may be movably connected to the lower module. Alternatively, the upper module and the lower module may be kept in a contact state without being connected to each other.

The media processing device may include media insertion/withdrawal modules 12 and 13 for an insertion/withdrawal of media.

The media insertion/withdrawal modules 12 and 13 may include a media storage space that a customer may access, and the media storage space may be open/closed by covering members such as a shutter and/or a cover and may sometimes remain open without being open or closed. The media storage space may be partitioned into a plurality of storage spaces by a partition member.

The media insertion/withdrawal modules 12 and 13 may serve as a common insertion/withdrawal part through which a plurality of types of media, such as a banknote, a check, and a gift certificate may be inserted and withdrawn. The media may be inserted into the media insertion/withdrawal modules 12 and 13 in units of sheets or bundles. Further, the media may be discharged to the media insertion/withdrawal modules 12 and 13 in units of sheets or bundles.

Alternatively, within the media insertion/withdrawal modules 12 and 13, the insertion space through which the media are inserted and the withdrawal space from which the media are withdrawn may be distinguished. Alternatively, the media insertion/withdrawal module may include a media insertion module and a media withdrawal module independent from each other.

The media processing device may further include a discrimination module (not shown). The discrimination module can identify a denomination, a thickness, an amount, or the like of media or defective media during deposit transaction and withdrawal transaction of media.

The media processing device may further include a temporary stacking module for temporarily stacking the media.

The temporary stacking module may temporarily stack the stored media through the media insertion/withdrawal module when a customer intends to deposit the media in the financial device.

The media stacked in the temporary stacking module may be transported to the media storing part be described later, when a customer finally decides to store the media. Alternatively, the temporary stacking module may temporarily stack the media to be transported to the media insertion/withdrawal module.

The media processing device may further include the media storing part for storing the media. The media storing part may include a plurality of media storage modules 100.

The plurality of media storage modules 100 may include one or more banknote storage module and one or more check storage module. In the present specification, it is noted that the number of banknote storage modules and the number of check storage modules are not limited. As another example, it is also possible that the media storing part may include only the banknote storage module or only the check storage module. Alternatively, the plurality of media storage modules 100 may include a storage module for storing gift certificates, securities, tickets, and the like. Alternatively, the check storage module may be replaced by the storage module that stores gift certificates, securities, tickets, and the like.

The media processing device may further include a supplement recovery module (not shown) for supplementing or recovering media. The supplement recovery module may store at least one of media to be supplemented in the media storing part and media recovered from the media storing part.

The media processing device may further include a recovery module (not shown). The recovery module may recover media determined to be defective media during at least one of a deposit transaction process of media, a withdrawal transaction process of media, a supplement process of media, and a recovery process of media. In other words, media which are withdrawn to the media insertion/withdrawal module but have not been received by the customer and/or which are determined as defective media in the discrimination module or media which are not recognized by the discrimination module may be accommodated.

In addition, the media processing device may further include a deposited check recovery space in which a deposit check transported from the media insertion/withdrawal module is recovered when the financial device includes a check deposit/withdrawal function. At this time, the deposit check may be recovered by differentiating a check issued from a bank operating the financial device from a check issued from another bank. The deposited check recovery space may also be configured as a separate module from the recovery module, or may be separately stacked in spaces partitioned in the recovery module. The recovery module and/or the check recovery space may be positioned at rearmost side of the financial device so that a clerk, a manager, or the like opens a door to easily access the recovery module and/or the check recovery space.

The media processing device may include a transportation module for transporting media inserted for deposit or media to be discharged for withdrawal to each of the modules.

Embodiment 1

Figure 2:
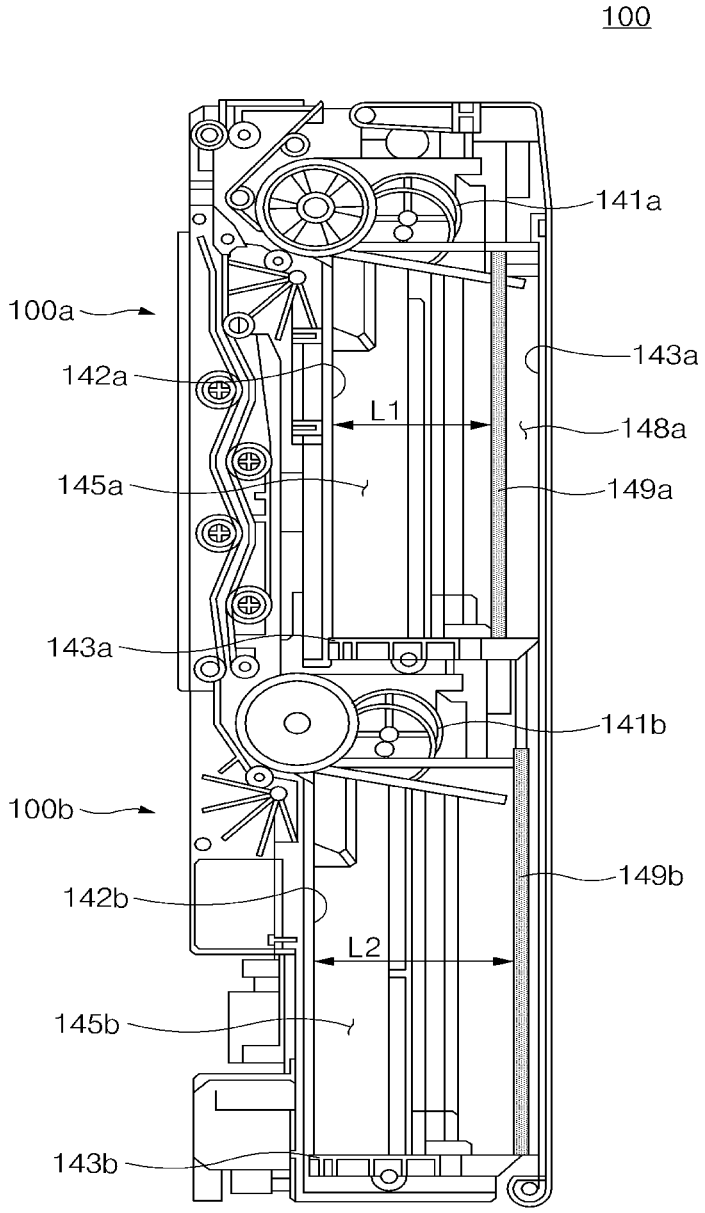
FIG. 2 is a cross-sectional view showing a cross section of a multi-media storage module used for a financial device according to the present disclosure.

Hereinafter, the media storage module 100 will be described in detail with reference to FIGS. 2 and 3. FIG. 2 is a cross-sectional view showing a cross section of a multi-media storage module used for a financial device according to the present disclosure.

The media storing part of the financial device according to Embodiment 1 of the present disclosure includes a plurality of media storage modules 100. The media storage module 100 may be used to stack the media transported by the transportation module or withdraw the stacked media to the transportation module. Here, the media storage module 100 has the same configuration as the media storage device of the embodiment to be described later, and uses different terms for convenience of explanation.

At least one of the media storage modules of the media storing part may include a plurality of storing parts. For example, referring to FIG. 2, the media storage module may include a first storing part 100*a* and a second storing part 100*b* provided under the first storing part 100*a*. The first and second storing parts 100*a* and 100*b* have the same configurations as those of first and second stacking parts of embodiments to be described later, and use different terms for convenience of explanation.

The first storing part 100*a* has a first stacking space 145*a* in which media are stacked and the second storing part 100*b* has a second stacking space 145*b* on which media are stacked. Further, the first stacking space 145*a* and the second stacking space 145*b* may have different sizes. Since the size of the media (horizontal width or vertical width) is various, the media stacked in a wider stacking space than the size of the media may cause problems such as the jam phenomenon upon the withdrawal. If the size of the first stacking space 145*a* and the size of the second stacking space 145*b* are different from each other, the media may be stored in the stacking space having a proper size corresponding to the size of the media.

The first storing part 100*a* may include a first damper 149*a* and the second storing part 100*b* may include a second damper 149*b*. The damper may align and stack the media inserted into the stacking space. More specifically, the media that are inserted into the stacking space collide with the damper having elasticity, and then may be aligned in the stacking space.

The size of the stacking space is determined by a coupled position of the dampers, a thickness and a shape of the damper, and the like. More specifically, the size of the first stacking space 145*a* is determined by a distance between a front surface 142*a* formed on a side into which the media of the first storing part 100*a* are inserted and the first damper 149*a*. Further, the size of the second stacking space 145*b* is determined by a distance between a front surface 142*b* formed on a side into which the media of the second storing part 100*b* are inserted and the second damper 149*b*.

If the distance between the front surface 142*a* of the first storing part 100*a* and the first damper 149*a* and the distance between the front surface 142*b* of the second storing part 100*b* and the second damper 149*b* are different from each other, the first stacking space 145*a* and the second stacking space 145*b* may have different sizes.

At least one of the first damper 149*a* and the second damper 149*b* may include a plate-shaped damping panel 144. The damping panel 144 may serve to damp the media that are inserted into the stacking space. FIG. 3 is a perspective view showing a coupled state of the damping panels according to the present disclosure.

Figure 3:
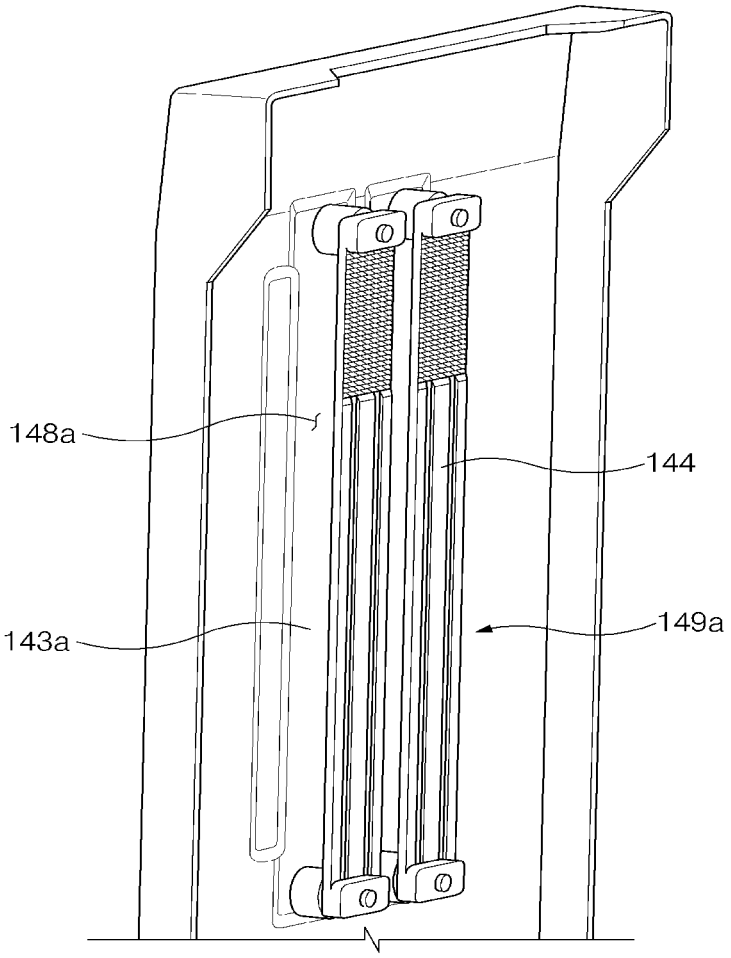
FIG. 3 is a perspective view showing a coupled state of damping panels according to the present disclosure.

Referring to FIG. 3, the damping panel 144 may be fixed to the storing part. More specifically, upper and lower ends of the damping panel 144 form a surplus space between the damping panel 144 and a rear surface 143*a* formed at a side opposite thereto and may be fixed to the rear surface 143*a*.

Referring to FIG. 2, the first storing part 100*a* may include a device (roller, or the like) for transporting media to the second stacking space 145*b* of the second storing part 100*b*. Accordingly, the first stacking space 145*a* may be relatively small in size. Accordingly, if the damper occupies a large space, the first stacking space 145*a* may be very narrow. As shown in FIG. 3, if the plate-shaped damping panel is used and the surplus space is formed between the damping panel and the rear surface 143*a*, the stacked media may be aligned by the damper having a simple and thin structure.

Figure 4:
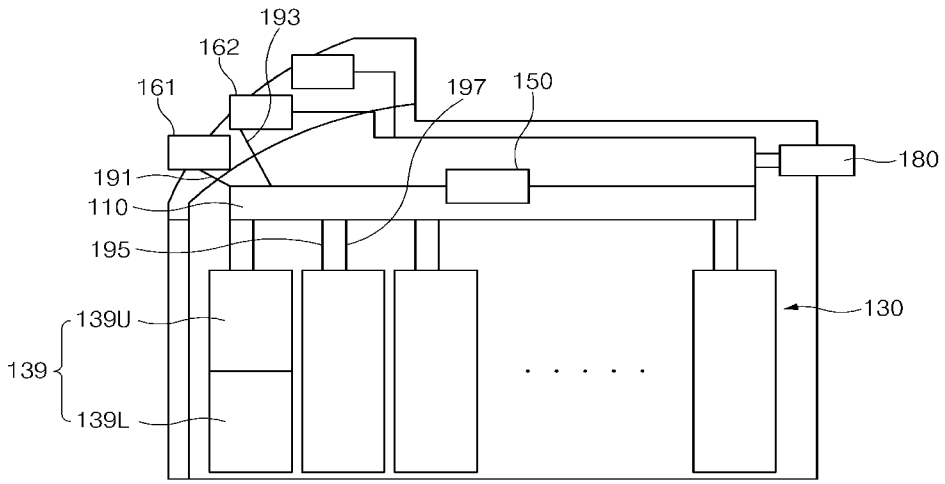
FIG. 4 is a configuration diagram conceptually showing an inside of a financial device according to Embodiment 1 of the present disclosure.

The above-mentioned media storage module may be used for the financial device. Hereinafter, the financial device using the media storage module having the plurality of storing parts will be described. FIG. 4 is a configuration diagram conceptually showing an inside of the financial device according to Embodiment 1 of the present disclosure.

The financial device according to Embodiment 1 of the present disclosure includes a transportation module 110, a media storing part 130, a discrimination module 150, and a controller 17.

The transportation module 110 transports media upon a user's transaction request. To this end, the transportation module 110 may include a belt, a roller pulley, and the like. Further, the transportation module 110 may further include a diverter (not shown) for guiding the transporting media to any one of the media storage modules to be described later. For example, media deposited in a deposit part 161 are guided to the transportation module 110 through a connection path 191, and then transported by the transportation module 110. Thereafter, the media is identified by the discrimination module 150 to be described later and guided to any one of the media storage modules by the diverter depending on the identified result. For the guidance, the transportation module 110 may be connected to each media storage module via branch paths 195 and 197.

The discrimination module 150 identifies the denomination of the media and whether the media are normal or abnormal. The discrimination module 150 may be positioned on the transfer path of the transportation module 110.

The controller may control the overall transportation of media such as the transportation from the transportation module 110 to the media storage module and the transportation from the media storage module to the transportation module 110. To this end, the controller may control a driver (e.g., a motor, etc.) or the diverter of the transportation module 110. In addition, the controller controls the media storing part 130. More specifically, the controller may control a belt, a roller, etc. of the media storage module to transport the media to the media storage module. A specific control of the controller will be described with reference to FIGS. 5 to 11. In FIGS. 5 to 11, a dotted line indicates a path through which media move in the corresponding control.

The media storing part 130 includes at least one media storage module for stacking the media transported by the transportation module 110 or for withdrawing the stacked media to the transportation module 110.

The media storage module may include a belt, the roller, and a diverter to allow the transportation module 110 to transport the media guided to the media storage module to the stacking space within the media storage module through the branch path 197 or carry the media stored in the stacking space within the media storage module to the transportation module 110 through the branch path 195. For reference, the media storage module may be separately provided with an inlet for inserting media into the media storage module from the transportation module 110 and an outlet for withdrawing the media to the transportation module 110 from the media storage module.

At least one of the media storage modules may be a multi-media storage module 139. Referring to FIG. 4, although the multi-media storage module 139 is provided on a leftmost side of the media storing part 130, a position of the multi-media storage module 139 is not necessarily limited thereto. As described above, the multi-media storage module 139 may include a first storing part 139U in which media are stacked and a second storing part 139L provided under the first storing part 139U. The first storing part 139U has a first stacking space in which media are stacked and the second storing part 139L has a second stacking space in which media are stored, in which the first stacking space and the second stacking space may have different sizes.

Hereinafter, a financial device using the above-mentioned multi-media storage module 139 as a temporary stacking module will be described. The financial device according to Embodiment 1 of the present disclosure may further include a deposit part 161 into which the media are inserted and a withdrawal part 162 from which the media are withdrawn. The deposit part 161 and the withdrawal part 162 may be implemented as the deposit and withdrawal part to be described later.

Figure 5:
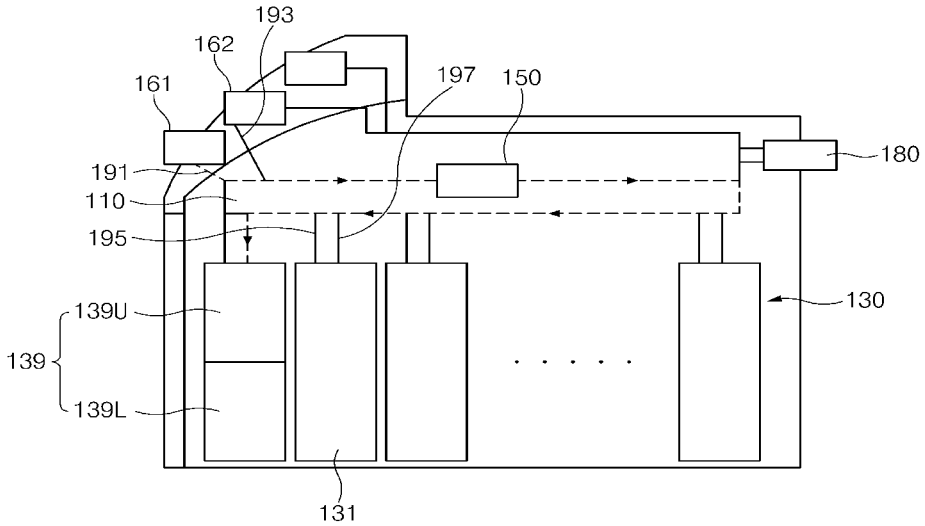
FIG. 5 is a conceptual diagram for explaining a control for a temporary stacking transportation of media according to Embodiment 1 of the present disclosure.
Figure 6:
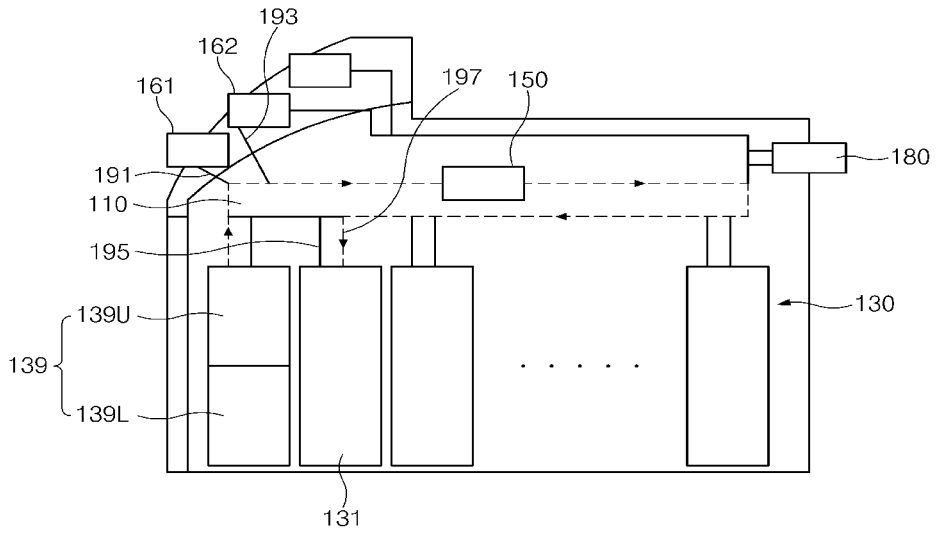
FIG. 6 is a conceptual diagram for explaining a control for a storage transportation of media according to Embodiment 1 of the present disclosure.
Figure 7:
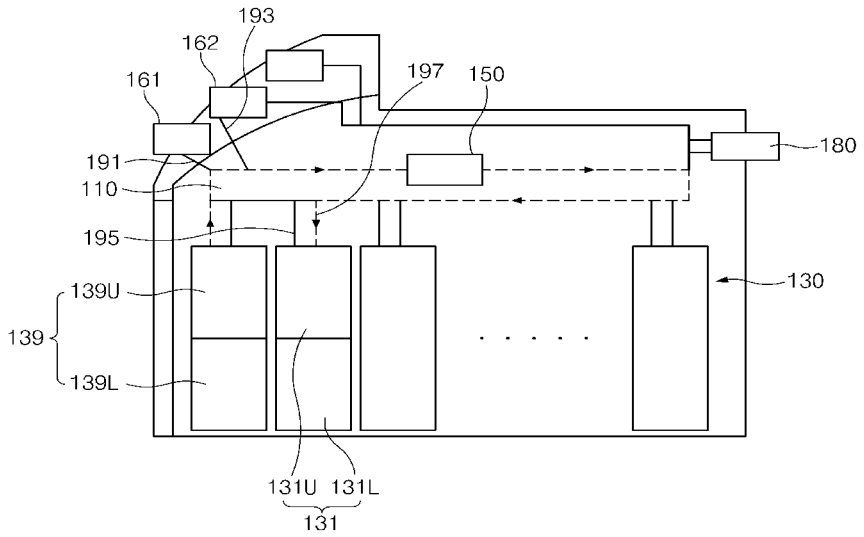
FIG. 7 is a conceptual diagram for explaining the control for the storage transportation of media according to Embodiment 1 of the present disclosure.

The controller may control the financial device to perform the temporary stacking transportation and the storage transportation when a user requests a deposit transaction. FIG. 5 is a conceptual diagram for explaining a control for a temporary stacking transportation of media according to Embodiment 1 of the present disclosure. FIGS. 6 and 7 are conceptual diagrams for explaining the control for the storage transportation of media according to Embodiment 1 of the present disclosure.

The term "temporary stacking transportation" refers to the transportation of media to temporarily store the inserted media when a user requests a deposit transaction. The financial device may include the temporary stacking module for the temporary stacking transportation and may use the media storage module as a temporary stacking module to temporarily stack a large number of media. Further, in order to stably accommodate various sizes of media, the multi-media storage module 139 may be used as a temporary stacking module.

Referring first to FIG. 5, a process of depositing media of a plurality of denominations in a financial device and stacking the media in the multi-media storage module 139 will be described.

Referring to FIG. 5, the media of the plurality of denominations are inserted in units of bundles through the deposit part 161 and are deposited randomly. The controller may control the media transported to the transportation module 110 through the connection path 191 to be transported to the multi-media storage module 139 via the discrimination module 150 when the user requests the deposit transaction. In addition, if the inserted media have various sizes of denominations, the controller may control the inserted media to be transported to any one of the first stacking space and the second stacking space having sizes corresponding to the sizes. For example, when the size of the first stacking space is smaller than the size of the second stacking space, the relatively smaller-sized media may be controlled to be stacked in the first stacking space and the relatively larger-sized media may be controlled to be stacked in the second stacking space.

The denominations and the number of media identified by the discrimination module 150 may be displayed on the interface, and the user may confirm them and then input the confirmation intention to the controller through a confirmation button or the like.

If it is confirmed that the denominations and the number of media identified by the discrimination module 150 match the denominations and the number of media inserted through the deposit part 161, the controller may perform a control to carry out the storage transportation. Referring to FIG. 6, the storage transportation refers to the transportation of the media stacked in the multi-media storage module 139 to the first media storage module 131, which is the media storage module of any other one of the plurality of media storage modules, through the discrimination module 150. FIG. 6 shows that all the media temporarily stacked in the multi-media storage module 139 are transported to the first media storage module 131 but each media identified by the discrimination module 150 may also be transported to be stacked in different media storage modules.

Meanwhile, the first media storage module 131 may also include a plurality of storing parts. Referring to FIG. 7, the first media storage module 131 may include a third storing part 131U and a fourth storing part 131L provided under the third storing part 131U. The third storing part 131U may have a third stacking space in which media are stacked and the fourth storing part 131L may have a fourth stacking space in which media are stacked. The third stacking space and the fourth stacking space may have different sizes.

If the storage transportation is performed by the first media storage module 131 having the plurality of storing parts, the controller may control the media transported to the first media storage module 131 to be transported to any one of the third stacking space and the fourth stacking space having sizes corresponding to the sizes of the media.

Figure 8:
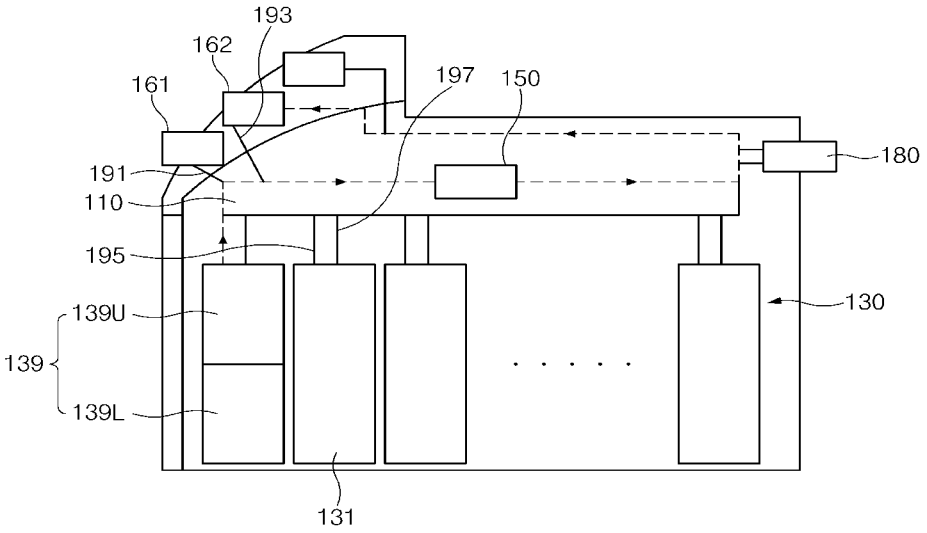
FIG. 8 is a conceptual diagram for explaining a control for a withdrawal transportation of media according to Embodiment 1 of the present disclosure.

If it is determined that the denominations and the number of media identified by the discrimination module 150 do not match the denominations and the number of media inserted through the deposit part 161, the controller may control the media stacked in the multi-media storage module 139 to be withdrawn and transported to the withdrawal part 162 (see FIG. 8). FIG. 8 is a conceptual diagram for explaining a control for a withdrawal transportation of media according to Embodiment 1 of the present disclosure.

FIG. 8 shows a control for the transportation of the media withdrawn from the multi-media storage module 139 to the withdrawal part 162 through the discrimination module 150. However, it is possible to control all the media temporarily stacked in the multi-media storage module 139 to be transported to a connection path 193 that leads to the withdrawal part 162 without identifying the denominations of media withdrawn through the discrimination module 150.

As described above, if the multi-media storage module 139 is used as the temporary stacking module, when various sizes of media are inserted, each media may be temporally stacked in a stacking space having a size corresponding to the size. Therefore, it is possible to relatively more evenly align media in the stacking space and to prevent the errors such as the jam phenomenon from occurring

Embodiment 2

Hereinafter, an exemplary embodiment of a financial device that uses a multi-media storage module having a plurality of storing parts in a ready-money verification process will be described. The ready-money verification means whether the total amount of the media stacked in the media storage module is equal to the total amount of the media electrically stored in the financial device. In order to allow the media stacked in the media storage module to be stored in the original media storage module again through the discrimination module, a collection transportation of withdrawing the media stacked in the media storage module and stacking the withdrawn media in another media storage module and a verification transportation of transporting the collectively transported media so that the collectively transported media is stored in the original media storage module through the discrimination module are performed.

Figure 9:
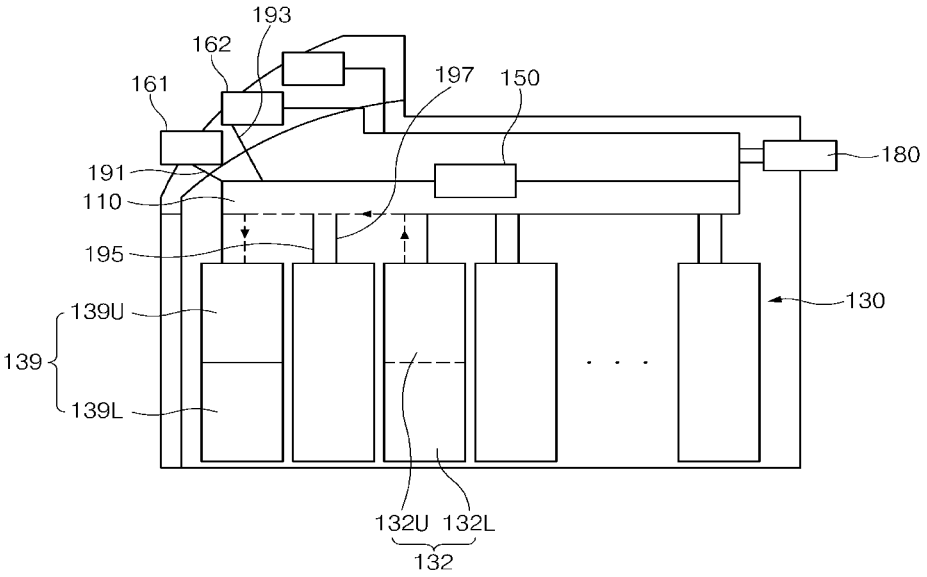
FIG. 9 is a conceptual diagram for explaining a control for a collection transportation of media according to Embodiment 2 of the present disclosure.
Figure 10:
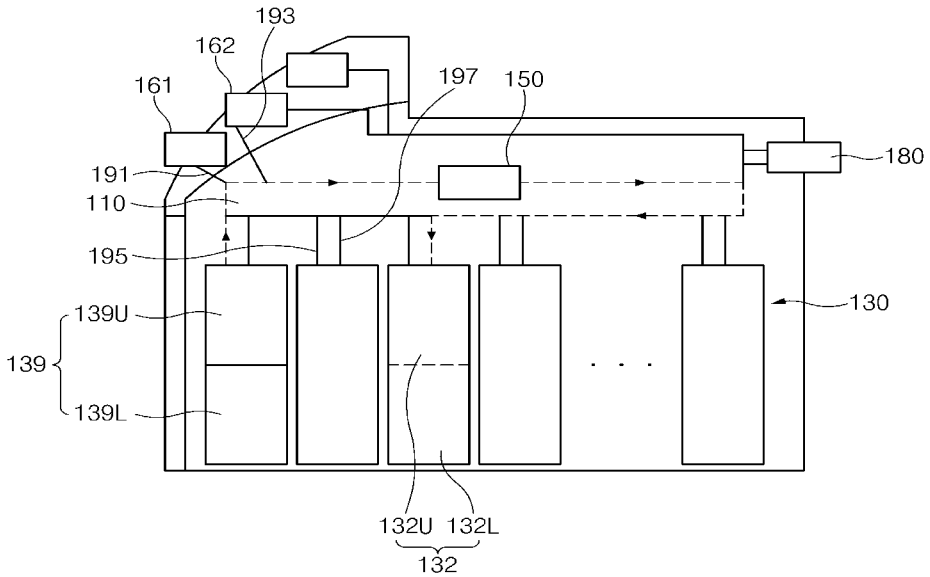
FIG. 10 is a conceptual diagram for explaining a control for a verification transportation of media according to Embodiment 2 of the present disclosure.
Figure 11:
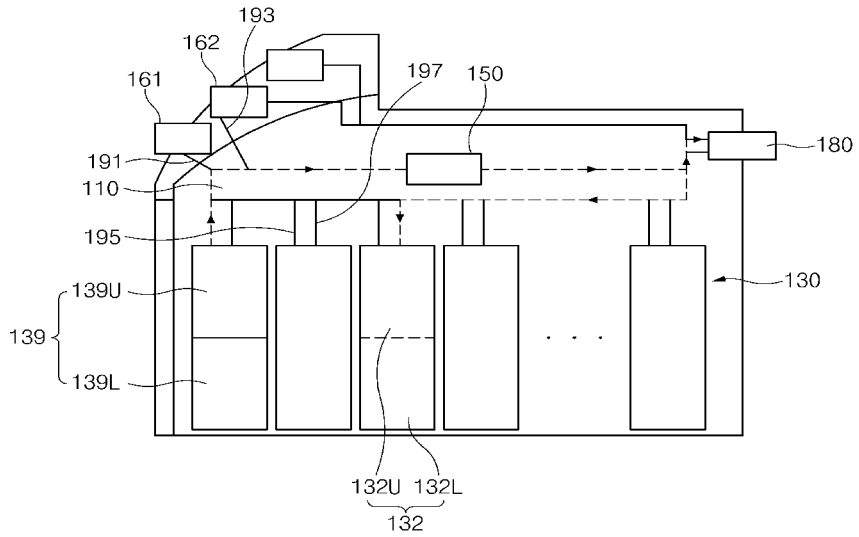
FIG. 11 is a conceptual diagram for explaining the control for the verification transportation of media according to Embodiment 2 of the present disclosure.

FIG. 9 is a conceptual diagram for explaining a control for a collection transportation of media according to Embodiment 2 of the present disclosure. FIGS. 10 and 11 are conceptual diagrams for explaining the control for the verification transportation of media according to Embodiment 2 of the present disclosure.

First, the collection transportation will be described with reference to FIG. 9. The media storing part 130 may include a second media storage module 132 in which media are stacked. When the ready-money verification on the second media storage module 132 is required, at least some of the media stacked in the second media storage module 132 are transported to the multi-media storage module 139. For example, all of the media stacked in the second media storage module 132 may be withdrawn to be transported to the multi-media storage module 139. Alternatively, only some of the media stacked in the second media storage module 132 may also be withdrawn to be transported to the multi-media storage module 139. If the number of media stacked in the second media storage module 132 is too large, only some media are collectively transported and suffer from the ready-money verification, such that it may be estimated that all of the media stacked in the second media storage module 132 suffer from the ready-money verification.

If media of a plurality of denominations are stacked in the second media storage module 132, the media transported to the multi-media storage module 139 may be transported to the first stacking space or the second stacking space having a size corresponding to the size thereof upon the collection transportation.

Further, the second media storage module 132 may include a fifth storing part 132U and a sixth storing part 132L provided under the fifth storing part 132U. The fifth storing part 132U has a fifth stacking space and the sixth storing part 132L has a sixth stacking space, in which the fifth stacking space and the sixth stacking space may have different sizes.

The media stacked in any one of the fifth storing part 132U and the sixth storing part 132L may be transported to any one of the first storing part 139U and the second storing part 139L. Further, the media stacked in the other of the fifth storing part 132U and the sixth storing part 132L may be transported to the other of the first storing part 139U and the second storing part 139L. For example, the media stacked in the fifth storing part 132U may be withdrawn to be transported to the first storing part 139U and the media stacked in the sixth storing part 132L may be withdrawn to be collectively transported to the second storing part 139L. Alternatively, the media stacked in the fifth storing part 132U may be collectively transported to the second storing part 139L and the media stacked in the sixth storing part 132L may be collectively transported to the first storing part 139U.

In addition, the transfer path between the second media storage module 132 and the multi-media storage module 139 may be additionally provided with a media sensing sensor (not shown) capable of counting the transported media. As the media sensing sensor, for example, an ultrasonic sensor or the like may be used. The media sensing sensor may sense that if more than two media is transported simultaneously, which may help to increase the accuracy of the ready-money verification.

The financial device according to Embodiment 2 of the present disclosure may further include a recovery module 180 for recovering a predetermined medium. The predetermined media may include a medium identified as a defective medium or may include a medium or the like that is not recognized by the discrimination module 150, or the like.

Meanwhile, the controller may confirm whether at least one of the first storing part 139U and the second storing part 139L is empty before the collection transportation. After the confirmation, the media may be controlled to be collectively transported to the empty storing part.

If predetermined media are stacked in the first storing part 139U and the second storing part 139L or the second media storage module 132 has a space insufficient to stack media that will suffer from the ready-money verification, the media stacked in any one of the first storing part 139U and the second storing part 139L may be transported to the recovery module 180.

Next, the verification transportation will be described with reference to FIG. 10. The media stacked in the multi-media storage module 139 by the collection transportation are withdrawn to the transportation module 110 and transported to at least any one of the plurality of media storage modules through the discrimination module 150. By passing through the discrimination module 150 in the verification transportation, the denominations and the number of media stored in the financial device may be compared with the denominations and the number of identified media to perform the ready-money verification.

Referring to FIG. 10, the verification transportation of the media that have been stacked in the second media storage module 132 to the second media storage module 132 may be performed. If the second media storage module 132 includes a plurality of storing parts, the media stacked in the fifth storing part 132U may be again transported to the fifth storing part 132U, and the media stacked in the sixth storing part 132L may be transported to the sixth storing part 132 again.

Also, if the discrimination module 150 identifies that the media are abnormal media rather than the normal media in the verification transportation, the abnormal media may be transported to the recovery module 180. In addition, if the denominations and the number of media identified by the discrimination module 150 do not match the denominations and the number of media stacked in the second media storage module 132, the controller may display the ready-money mismatch to the user through the interface.

As described above, after the media stacked in the second media storage module 132 are collectively transported to the multi-media storage module 139, the collectively transported media are withdrawn again and pass through the discrimination module 150, and then the verification transportation of the collectively transported media to the second media storage module 132 is performed, such that the ready-money verification on the media stacked in the second media storage module 132 may be completed. If the data stored in the financial device (the number of media, a serial number or the like) differs from the identification result by the discrimination module 150, a ready-money verification request message may be displayed through the interface, the network, the display, and/or the voice

Embodiment 3

Figure 12:
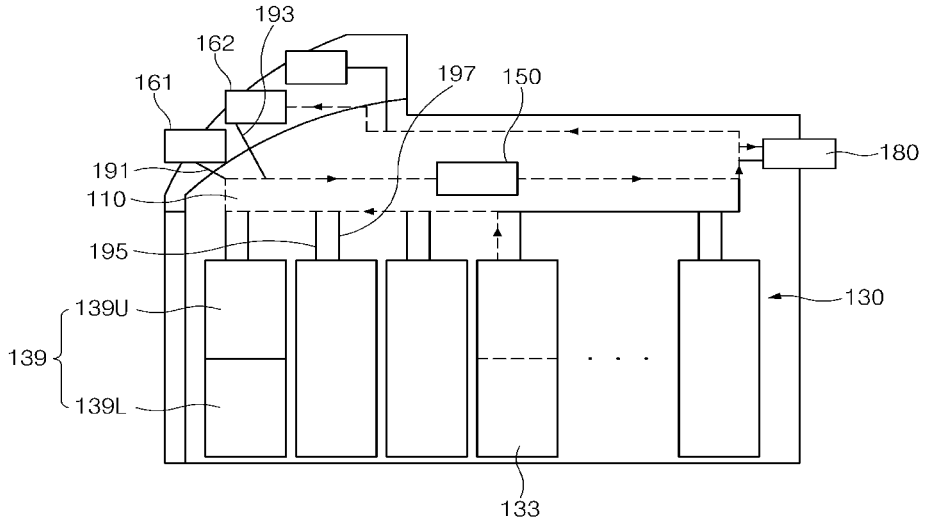
FIG. 12 is a conceptual diagram for explaining a control for withdrawal transportation for media of a plurality of denominations according to Embodiment 3 of the present disclosure.

FIG. 12 is a conceptual diagram for explaining a control for withdrawal transportation for media of a plurality of denominations according to Embodiment 3 of the present disclosure.

In the case of media including various sizes of denominations like the euro, it may not be easy to include the media storage module corresponding to each size because the overall size of the financial device is getting larger. Therefore, the media of the plurality of denominations may be mixed and stored in one media storage module.

The media storing part 130 may include a third media storage module 133 in which the media of the plurality of denominations are stacked. First, the case where the third media storage module 133 includes a single storing part will be described.

The controller may control the media stacked in the third media storage module 133 to be transported to the withdrawal part 162 through the discrimination module 150 when the withdrawal transaction for some denominations of the media stacked in the third media storage module 133 is requested by the user. At this time, the controller may control the media of the denomination requested to be withdrawn to be transported to the withdrawal part 162 and media other than the denomination requested to be withdrawn to be transported to the withdrawal module 180. That is, the controller may control the media of all the denominations to be withdrawn from the third media storage module 133 and the denominations to be identified using the discrimination module 150 and control only the media of the denominations requested to be withdrawn to be transported to the withdrawal part 162.

If the third media storage module 133 is the media storage module having the plurality of storing parts, the media of the plurality of denominations may be stacked in different storing parts. When a user requests the withdrawal transaction, the controller may control only the media of the storing part, in which the media requested to be withdrawn are stacked, to be withdrawn and may control the media to be transported to the withdrawal part 162 through the discrimination module. It is possible to prevent the jamming phenomenon from occurring because the media of all denominations are not withdrawn.

Embodiment 4

Figure 13:
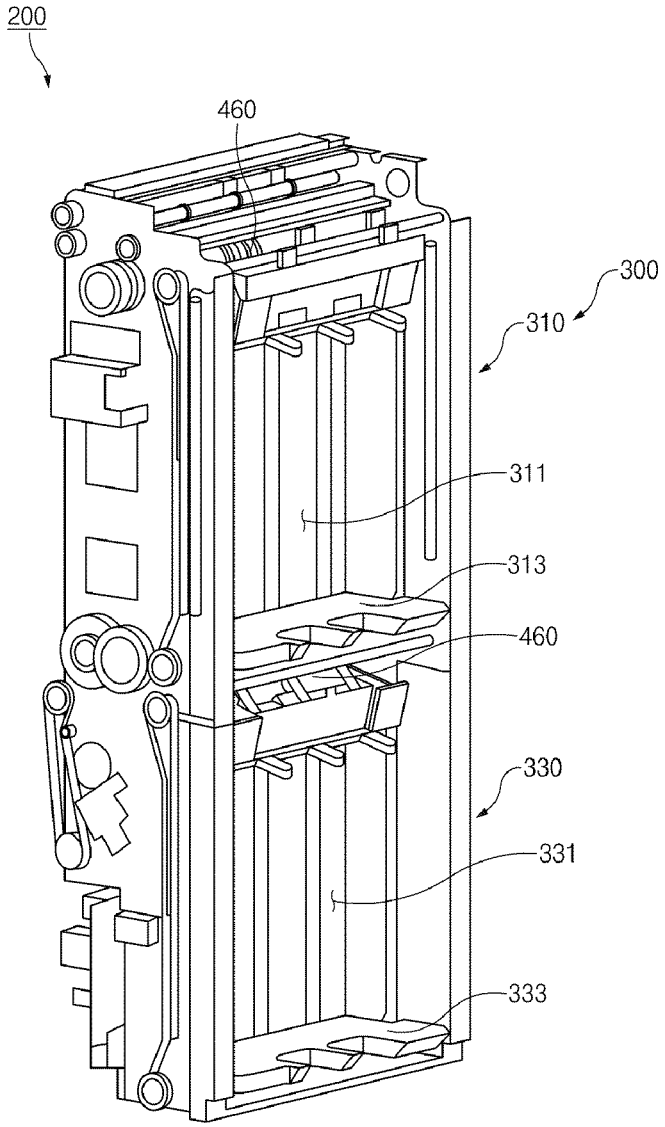
FIG. 13 is a front internal perspective view showing an internal structure of a media storage device according to Embodiment 4 of the present disclosure.
Figure 14:
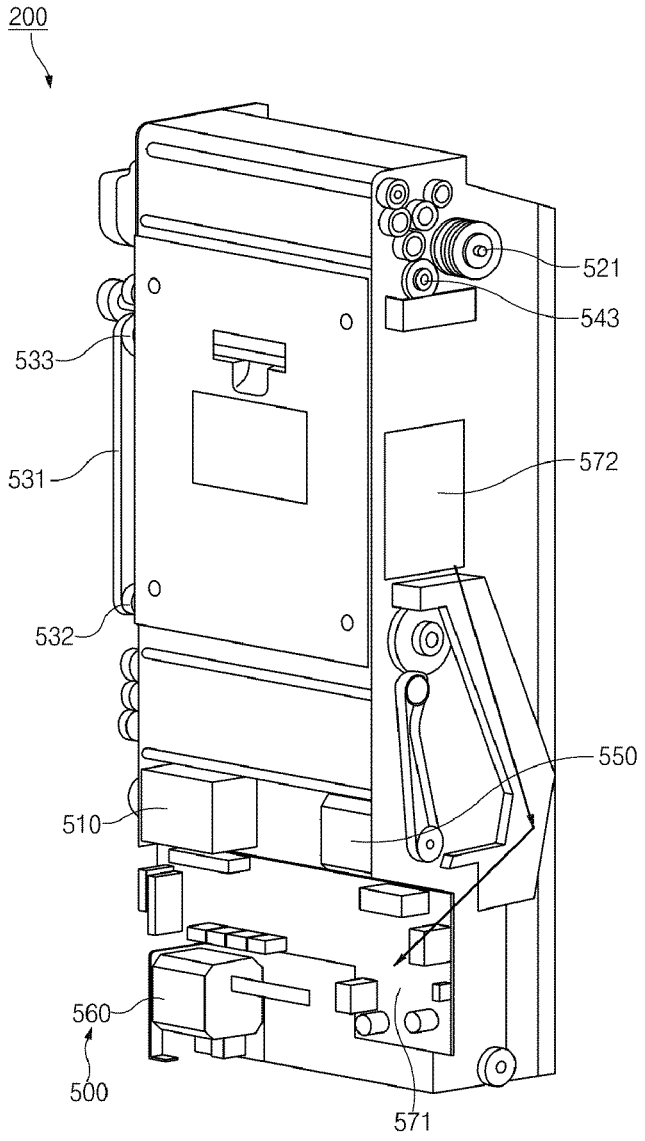
FIG. 14 is a rear perspective view showing a rear surface of FIG. 13.
Figure 15:
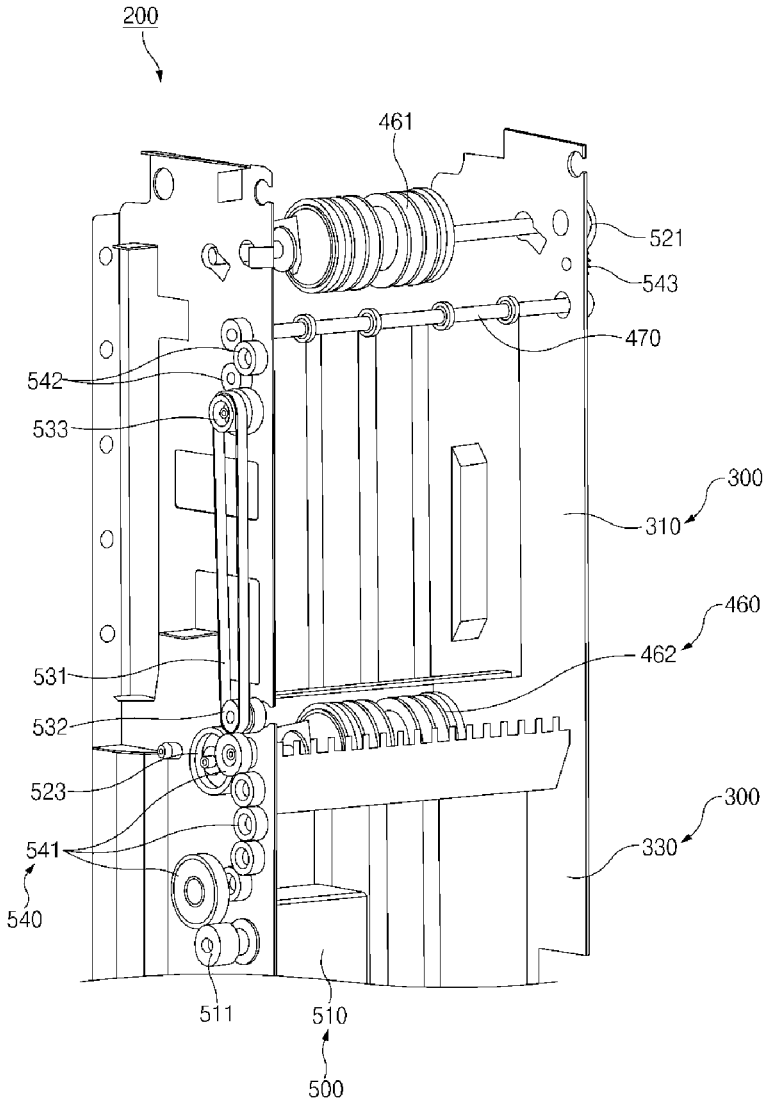
FIG. 15 is an exploded rear perspective view illustrating some components of FIG. 14.
Figure 16:
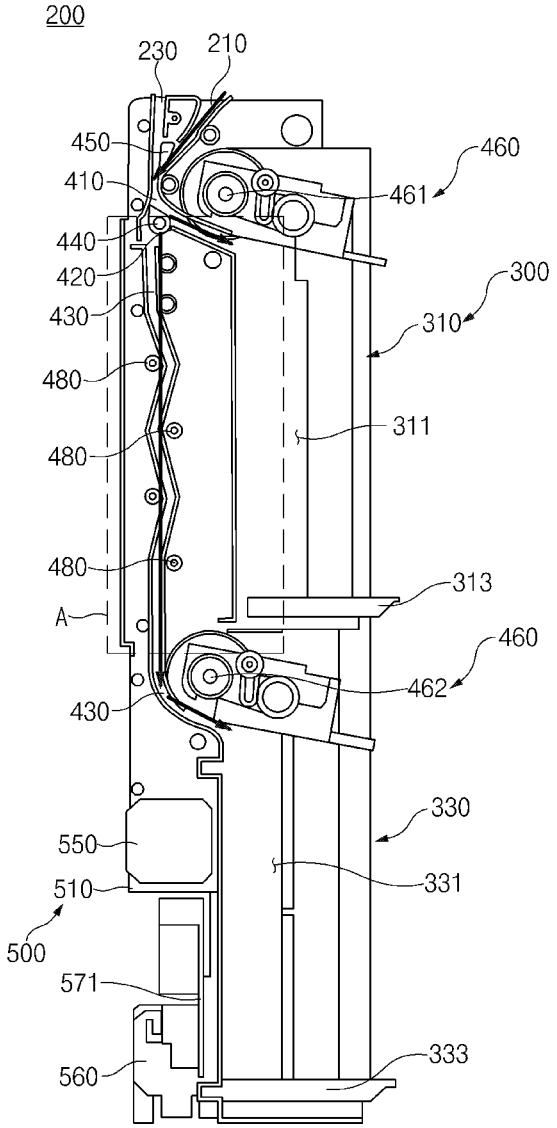
FIG. 16 is a side cross-sectional view showing an operation in which media are inserted into the media storage device according to Embodiment 4 of the present disclosure.
Figure 17:
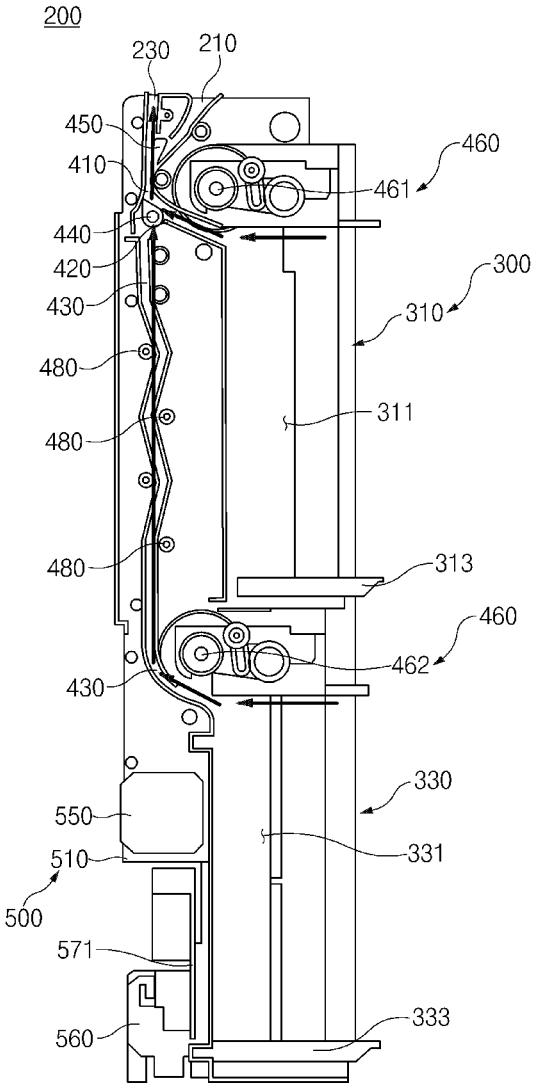
FIG. 17 is a side cross-sectional view showing an operation in which media are withdrawn from the media storage device according to Embodiment 4 of the present disclosure.
Figure 18:
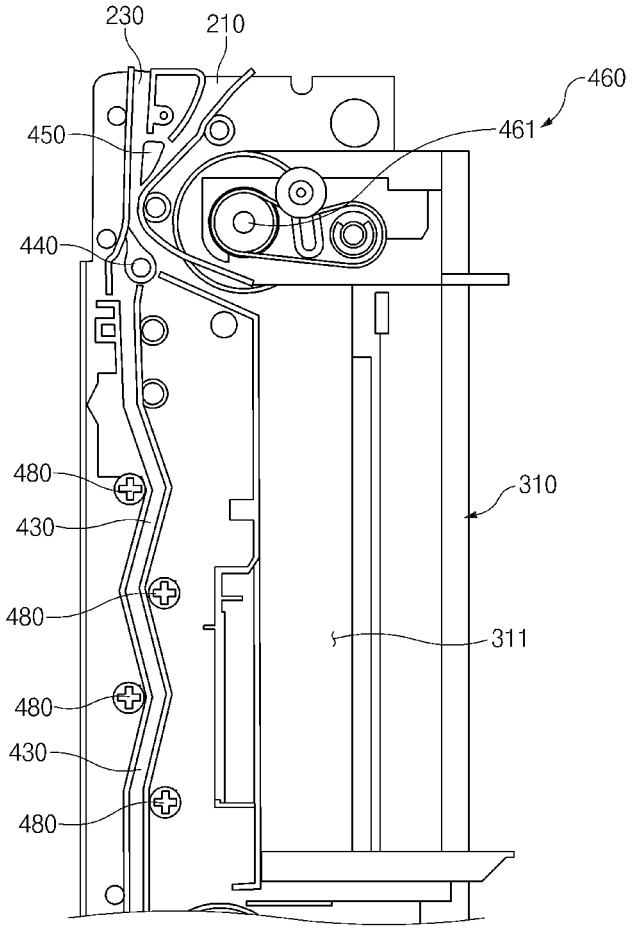
FIG. 18 is a partially enlarged side cross-sectional view of part A of FIG. 16.
Figure 19:
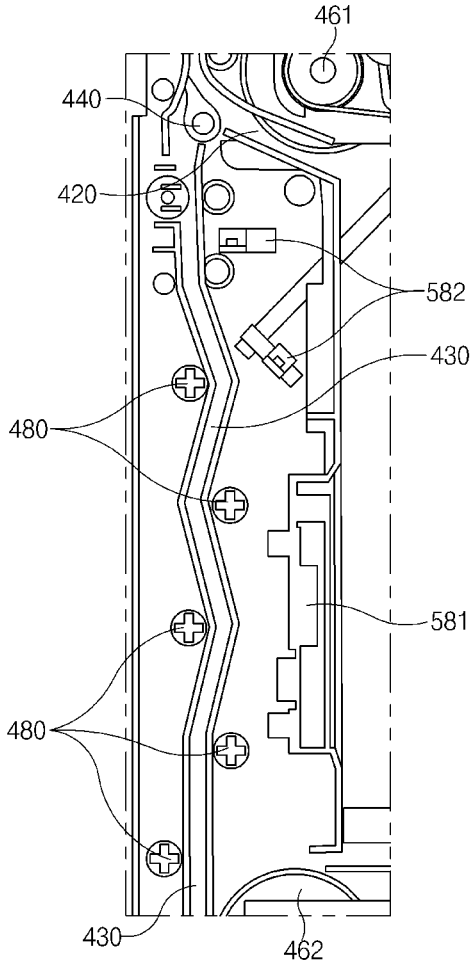
FIG. 19 is an enlarged side cross-sectional view of a third transfer path shown in FIG. 18.

Hereinafter, the media storage device 200 according to Embodiment 4 of the present disclosure will be described with reference to FIGS. 13 to 19. FIG. 13 is a front internal perspective view showing an internal structure of a media storage device 200 according to Embodiment 4 of the present disclosure and FIG. 14 is a rear perspective view showing a rear surface of FIG. 13. FIG. 15 is an exploded rear perspective view illustrating some components of FIG. 14, FIG. 16 is a side cross-sectional view showing an operation in which media are inserted into the media storage device 200 according to Embodiment 4 of the present disclosure, FIG. 17 is a side cross-sectional view showing an operation in which media are withdrawn from the media storage device 200 according to Embodiment 4 of the present disclosure, FIG. 18 is a partially enlarged side cross-sectional view of part A of FIG. 16, and FIG. 19 is an enlarged side cross-sectional view of a third transfer path shown in FIG. 18.

As in the embodiments shown in FIGS. 13 to 18, the media storage device 200 according to the present disclosure includes a media inlet 210 through which media are inserted, a media stacking part 300 in which the media inserted through the media inlet 210 are stacked and including a plurality of media stacking spaces 311 and 331 separated from each other, a first transfer path 410 through which the media inserted through the media inlet 210 are transported, a first diverter 440 controlling the transportation direction of the media so that the media transported along the first transfer path 410 are transported to any one of the plurality of media stacking spaces 311 and 331, and a driver 500 providing a driving force for stacking the media in the plurality of media stacking spaces 311 and 331.

Here, the driver 500 is disposed on one side of any one of the plurality of media stacking spaces 311 and 331.

Specifically, the media stacking part 300 may form an appearance of the media storage device 200 and include the plurality of media stacking spaces 311 and 331 provided therein. At this time, the plurality of media stacking spaces 311 and 331 may be partitioned in the media stacking part 300 and separated from each other. In the illustrated example, the media stacking space is shown as including the first stacking space 311 and the second stacking space 331, but the number of media stacking spaces is not limited thereto but may be divided into a plurality of spaces of three or more.

Further, the plurality of media stacking spaces 311 and 331 may be formed in two stages in the vertical direction. However, the disposition of the plurality of media stacking spaces 311 and 331 is not limited thereto, and the plurality of media stacking spaces 311 and 331 may also be disposed in a horizontal direction or the like as long as they may be disposed to be separated from each other.

Media of different denominations may be stored in the plurality of media stacking spaces 311 and 331, and media of the same denomination may be stored according to the use state, and sizes of the plurality of media spaces may be the same or different.

The media inlet 210 communicates with the media stacking part 300, and may be inserted with the media deposited in the deposit and withdrawal part of the financial device 1. The media inserted into the media inlet 210 may be stacked in the media stacking part 300.

The media inlet 210 may be connected to the first transfer path 410. That is, the first transfer path 410 may be a path through which the media inserted through the media inlet 210 are transported to the plurality of media stacking spaces 311 and 331.

At this time, the first transfer path 410 is branched to the transfer path connected to the plurality of media stacking spaces 311 and 331. For example, if the media stacking space is divided into the first stacking space 311 and the second stacking space 331 as the illustrated example, the first transfer path 410 may be branched into a second transfer path 420 connected to the first stacking space 311 and a third transfer path 430 connected to the second stacking space 331. If the media stacking space is branched to three or more, the first transfer path 410 may be branched into three or more transfer paths.

The first diverter 440 may control the transportation direction of the media so that the media transported along the first transfer path 410 are transported to any one of the plurality of media stacking spaces 311 and 331. That is, the first diverter 440 may be provided at a branch point where the first transfer path 410 is branched. The first diverter 440 may control the transportation direction of the media by opening any one of the plurality of branched transfer paths and blocking the remaining transfer paths.

The driver 500 provides a driving force for stacking the media in the plurality of media stacking spaces 311 and 331.

That is, the driver 500 may provide power for transporting the inserted media and stacking the inserted media in the media stacking part 300 or provide power to a support plate for supporting the media stacked in each media stacking space.

Here, the driver 500 may be disposed on one side of any one of the plurality of media stacking spaces 311 and 331. That is, the driver 500 may include a plurality of components such as a plurality of motors. The driver 500 may be disposed at one side of any one of the plurality of media stacking spaces 311 and 331 to prevent the interference with other components or the hindrance of the transfer path, thereby efficiently utilizing the space of the media storage device 200 having the plurality of media stacking spaces 311 and 331.

Accordingly, the limited space of the media storage device 200 according to the present disclosure may be efficiently used. Therefore, it is possible to prevent the problem that the media stacking space becomes narrow or the size of the media storage device 200 becomes large due to the arrangement of the components such as the driver 500 and reduce the size of the media storage device 200 according to the use state to increase the number of media storage devices 200 mounted inside the financial device 1.

Meanwhile, as in the exemplary embodiments shown in FIGS. 16 to 18, the media storage device 200 may further include a media outlet 230 through which the media stacked in the plurality of media stacking spaces 311 and 331 are withdrawn and a second diverter 450 provided at the connected portion between the media inlet 210 and the media outlet 230 to control the transportation direction of the media.

That is, in the media storage device 200 according to the present disclosure, the media inlet 210 through which the media is inserted and the media outlet 230 through which the media is withdrawn may be separately provided at an upper portion of the media stacking part 300. Further, the media inlet 210 and the media outlet 230 may be connected to each other at an entrance of the first transfer path 410. However, the present disclosure is not limited thereto, and the media inlet 210 and the media outlet 230 may also be formed as one opening. Here, the media inlet 210 has the same configuration as the inlet and the media outlet 230 has the same configuration as the outlet of the embodiment to be described above and the media inlet and/or media outlet is presented an inlet/outlet.

The second diverter 450 may be installed at a point where the media inlet 210 and the media outlet 230 are connected to each other. Further, the media inlet 210 or the media outlet 230 may communicate with the first transfer path 410 to control the transportation direction of media. In detail, as in the exemplary embodiment shown in FIG. 16, if media are inserted into the media stacking part 300, the second diverter 450 may block the media outlet 230 and connect between the media inlet 210 and the first transfer path 410. On the other hand, as in the exemplary embodiment shown in FIG. 17, if media stacked in the media stacking part 300 are withdrawn to the outside, the second diverter 450 may block the media inlet 210 and connect between the media outlet 230 and the first transfer path 410.

Specifically, the media stacking part 300 includes a first stacking part 310 including the first stacking space 311 included in the media stacking space, a second stacking part 330 including the second stacking space 331 separated from the first stacking space 311 and disposed under the first stacking part 310.

Here, the driver 500 may be disposed on a side surface of the second stacking part 330.

That is, the media stacking part 300 includes the first stacking part 310 and the second stacking part 330, in which the first stacking part 310 and the second stacking part 330 may be vertically disposed. Further, the first stacking part 310 and the second stacking part 330 may include the first stacking space 311 and the second stacking space 331 that are separated from each other.

Further, the driver 500 may be disposed on one side surface of the second stacking part 330 disposed under the media stacking part 300. For example, like the shown exemplary embodiment, the driver 500 may be disposed on a rear surface of the second stacking part 330. Accordingly, it is possible to reduce the overall size of the media storage device 200 by disposing the driver 500 including a bulky driving member at a lower portion thereof.

Referring to the exemplary embodiment shown in FIGS. 18 and 19, in the media storage device 200 according to the present disclosure, the first transfer path 410 may be branched into the second transfer path 420 and the third transfer path 430, the second transfer path 420 may be connected to the first stacking space 311, and the third transfer path 430 may be connected to the second stacking space 331.

Here, the third transfer path 430 may be disposed on a side surface of the first stacking part 310.

The third transfer path 430 is a path through which the media inserted into or withdrawn from the media inlet 210 or the media outlet 230 positioned on the media storage device 200 is transported and a path connected to the second stacking space 331. Like the illustrated example, if the first stacking part 310 and the second stacking part 330 are vertically disposed and a lower end portion of the third transfer path 430 is connected to an upper side of the second stacking space 331, the third transfer path 430 may be disposed on the side surface of the first stacking part 310.

Further, the media storage device 200 may further include a driving roller 480 that is disposed on the side surface of the third transfer path 430 and provides the driving force to the media transported to the third transfer path 430. The driving roller 480 may be driven by receiving driving force from a main driving member 510.

At this time, if the driver 500 for stacking the media in the first stacking part 310 and the second stacking part 330 or the driver 500 for stacking the media in the first stacking part 310 is disposed in the first stacking part 310 disposed at the upper portion of the media storage device 200, a width of the third transfer path 430 may be narrow to cause a trouble in transporting the media. The width of the media storage device 200 needs to become large in order to avoid the above problem, which lead to cause the problem.

Accordingly, in the media storage device 200 according to the present disclosure, the first stacking part 310 and the third transfer path may be disposed at the upper side thereof and the second stacking part 330 and the driver 500 including the second stacking part 330 and the plurality of driving members may be disposed at the lower portion thereof.

That is, by disposing the driver 500 on one side (for example, rear side) of the second stacking part, the driver 500 may be disposed at the lower portion of the media storage device to keep the size of the third transfer path 430 large, thereby smoothly transporting the media. In addition, since the third transfer path 430 is disposed at the upper portion, the transfer path is not disposed at the lower portion of the media stacking part 300, and therefore the relatively bulky driver 500 is disposed at the lower portion thereof, thereby reducing the overall size of the media storage device 200. The driver 500 for stacking media in the first stacking part 310 and the second stacking part 330 or the driver 500 for stacking media in the first stacking part 310 may be disposed at the second stacking part 330 disposed at the lower portion of the media storage device 200 to keep the size of the third transfer path 430 large, thereby smoothly transporting the media. Accordingly, it is possible to maximize the space utilization by efficiently disposing the components inside the media storage device 200 having the plurality of media stacking spaces.

Referring to the exemplary embodiments shown in FIGS. 14 to 16, the driver 500 may include a main driving member 510 providing a driving force to the first transport path 410 and providing a driving force to a plurality of separating modules 460 that transport the media transported to the first transport path 310 to the plurality of media stacking spaces 311 and 331, a first support plate driving member 550 providing a driving force to a first support plate 313 that supports the media stacked in the first stacking space 311 at the lower portion thereof, and a second support plate driving member 560 providing a driving force to a second support plate 333 that supports the lower portion of the media stacked in the second stacking space 331. At this time, the separating module 460 may be configured to transport the media to the plurality of media stacking spaces 311 and 331 or separate the media stacked in the plurality of media stacking spaces 311 and 331 sheet by sheet and withdraw the media to the outside of the stacking space. Here, the first and second support plates 313 and 333 have the same configuration as a push plate of the foregoing exemplary embodiment or first and second media pushers of exemplary embodiments to be described later, and other terms are used for convenience of explanation.

The separating module 460 may include a first separating member 461 transporting media to the first stacking space 311 or withdrawing the media stored in the first stacking space 311 and provided in the first stacking part 310 and a second separating member 462 transporting media to the second stacking space 331 or withdrawing the media stored in the second stacking space 331 and provided in the second stacking part 330.

The separating module 460 may include, for example, a feed roller, a gate roller, and a pick-up roller. In detail, the first separating member 461 and the second separating member 462 may include the feed roller that transports and stacks the media inserted into the first stacking space 311 and the second stacking space 331, the pick-up roller that picks up and withdraws the media stored in the first stacking space 311 and the second stacking space 331, and the gate roller. However, the separating member 460 is not limited thereto, and therefore various components for transporting the media may be applied. Further, hereinafter, the case where the first separating member 461 and the second separating member 462 are the feed roller, the gate roller, or the pick-up roller will be described by way of example.

Further, the main driving member 510 may provide a driving force for driving at least one of the first separating member 461 and the second separating member 462. That is, one main driving member 510 may be a driving source for driving the first separating member 461 and the second separating member 462. However, the first separating member 461 and the second separating member 462 may be driven by one main driving member 510, but may also be driven by a separate driving source.

Referring to FIGS. 13 and 14, the first support plate driving member 550 may provide a driving force to the first support plate 313 that supports the media stacked in the first stacking space 311 at the lower portion thereof.

That is, the first support plate 313 is disposed in the first stacking space 311 to support the media transported to the first stacking space 311, and rises when the media are withdrawn to press the media toward the first separating member 461, such that the media may be easily picked up. The first support plate driving member 550 may provide a driving force for driving the first support plate 313 up and down. Here, as in the exemplary embodiment shown in FIGS. 14 and 16, the first support plate driving member 550 may be disposed on the side surface of the second stacking part 330.

The second support plate driving member 560 may provide a driving force to the second support plate 333 that supports the media stacked in the second stacking space 331 at the lower portion thereof.

That is, the second support plate 333 may be disposed in the second stacking space 331 to support the media transported to the second stacking space 331 and the second support plate driving member 560 may provide a driving force for driving the second support plate 333 up and down. At this time, like the first support plate driving member 560, the second support plate driving member 560 may be disposed on the side surface of the second stacking part 330. The first support plate driving member 550 and the second support plate driving member 560 are relatively small in size and may be provided in two to independently drive the support plates 313 and 333 each provided in the first and second stacking parts. Further, the main driving member 510 is relatively large in size and drives the first separating member 461 and the second separating member 462 and the driving roller 480 as described later, and the first separating member 461 and the second separating member 462 may independently control power from the main driving member 510 through electromagnetic clutches 521 and 523 each connected thereto.

Accordingly, the first support plate driving member 550 and the second support plate driving member 560 included in the driver 500 are disposed at the lower portion of the media storage device 200, such that the media storage device 200 may increase the internal space utilization when it includes the plurality of media stacking spaces 311 and 331.

Meanwhile, the financial device 1 may further include a power transmission unit for transmitting a driving force of the main driving member 510 to at least any one of the first separating member 461 and the second separating member 462.

Specifically, as in the exemplary embodiment shown in FIG. 15, the power transmission unit may include a first clutch 521 and a second clutch 523, a gear part 540, and a driving belt 531.

The first clutch 521 may be connected to the first separating member 461 to rotate the first separating member 461 by an electromagnetic force. That is, the first clutch 521 is connected to a rotating shaft connected to the first separating member 461 to intermittently transmit the driving force of the main driving member 510, thereby turning on/off the rotation of the first separating member 461.

The second clutch 523 may be connected to the second separating member 462 to rotate the second separating member 462 by the electromagnetic force. That is, like the first clutch 521, the second clutch 523 may be connected to the rotating shaft on which the second separating member 462 is installed, thereby turning on/off the rotation of the second separating member 462 by the electromagnetic force.

Meanwhile, the gear part 540 may be connected to the driving gear 511 of the main driving member 510 and may be connected to at least one of the first clutch 521 and the second clutch 523 to transmit power.

More specifically, the gear part 540 may include a first transmission gear 541, a second transmission gear 542, and a third transmission gear 543.

The first transmission gear 541 may be installed to be engaged with the driving gear 511 installed in the main driving member 510 and may be connected to the second clutch 523. The third transmission gear 543 may be engaged with the first clutch 521 and one end portion of a power transmission shaft 470 so that the power transmission shaft 470 is interlocked with the first clutch 521. The second transmission gear 542 may be connected to the power transmission shaft 470 at the other end portion of the power transmission shaft 470, that is, an end portion opposite to the side to which the third transmission gear 543 is connected. Here, the power transmission shaft 470 may be provided with a separating member such as the feed roller.

The driving belt 531 may be connected to the driving gear 511 connected to the main driving member 510 by the gear part 540 and may be connected to the power transmission shaft 470, which is connected to the second clutch 523 disposed in the first stacking part 310, by the gear part 540 to transmit the driving force of the main driving member 510 to the second clutch 523.

Specifically, an upper end of the driving belt 531 may be installed to be wound around an upper driving pulley 533, a lower end thereof may be installed to be wound around a lower driving pulley 532, the lower driving pulley 532 may be connected to the first transmission gear 541, and the upper driving pulley 533 may be connected to be engaged with the second transmission gear 542.

Here, the first transmission gear 541, the second transmission gear 542, and the third transmission gear 543 may each be formed into one or may each include a plurality of gears.

By Embodiment 4 of the driver 500 configured as described above, the first separating member 461 and the second separating member 462 may be selectively driven by one main driving member 510 disposed on the side surface of the second stacking part 330. For example, if the media stacked in the first stacking space 311 or the second stacking space 331 are withdrawn, the first separating member 461 or the second separating member 462 may be selectively driven by the main driving member 510. If selectively driven, when any one of the first clutch 521 and the second clutch 523 is driven, the other is in an idle state and thus is not driven. The operation of the driver 500 according to Embodiment 4 is as follows.

First, when the driving force of the main driving member 510 is transmitted to the first separating member 461, if the driving gear 511 of the main driving member 510 is rotated, the first transmission gear 541 engaged with the driving gear 511 is rotated to drive the driving belt 531 while rotating the lower driving pulley 532. Further, the power transmission shaft 470 is rotated by the second transmission gear 542 engaged with the upper driving pulley 533 connected to the driving belt 531 and the third transmission gear 543 is rotated depending on the rotation of the power transmission shaft 470 to transmit power to the first clutch 521 engaged with the third transmission gear 543 Thereafter, the first separating member 461 may be rotated by the electromagnetic force of the first clutch 521.

Next, when the driving force of the main driving member 510 is transmitted to the second separating member 462, if the driving gear 511 of the main driving member 510 is rotated, the first transmission gear 541 engaged with the driving gear 511 may be rotated to transmit power to the second clutch 523 engaged with the first transmission gear 541. Thereafter, the second separating member 462 may be rotated by the electromagnetic force of the second clutch 523.

Meanwhile, the media storage device 200 according to the present disclosure may further include a sub board 572 disposed on one side of the first stacking part 310 and electrically connected to a part disposed adjacent to the first stacking part 310 and a main board 571 electrically connected to the sub board 572, disposed at one side of the second stacking part 330, and connected to components, which are not connected to the sub board 572, among components included in the media stacking part 300.

That is, the media storage device 200 according to the present disclosure may connect components mounted therein to the main board 571 and the sub board 572, respectively. Specifically, the components of the first stacking part 310 disposed at the upper portion of the media storage device 200 may be connected to the sub board 572 and the components of the second stacking part 330 disposed at the lower portion thereof may be connected to the main board 571.

Accordingly, compared to the typical case where all the components are connected to the single main board 571, the size of the main board 571 may be minimized and the size of the main board 571 and the sub board 572 may be adjusted, such that the lower space of the side surface of the second stacking space 331 may be more efficiently utilized.

Further, referring to the exemplary embodiment shown in FIG. 19, the media storage device 200 according to the present disclosure may further include a dip switch 581 disposed at one side of the first stacking part 310 and selecting denominations stacked in each of the plurality of media stacking spaces 311 and 331 and transmitting the selected denominations to a central processing unit.

Further, one or a plurality of sensors 582 for understanding the positions and states of media are disposed in the first and second stacking parts 310 and 330 and the plurality of transfer paths 410 and 420. Accordingly, An efficient arrangement can be achieved in the limited space.

According to the present disclosure, the limited space within the media storage device including the plurality of media stacking spaces can be efficiently used to improve the transportation quality of media and increase the number of media storage devices mounted inside the financial device.

Embodiment 5

Figure 20:
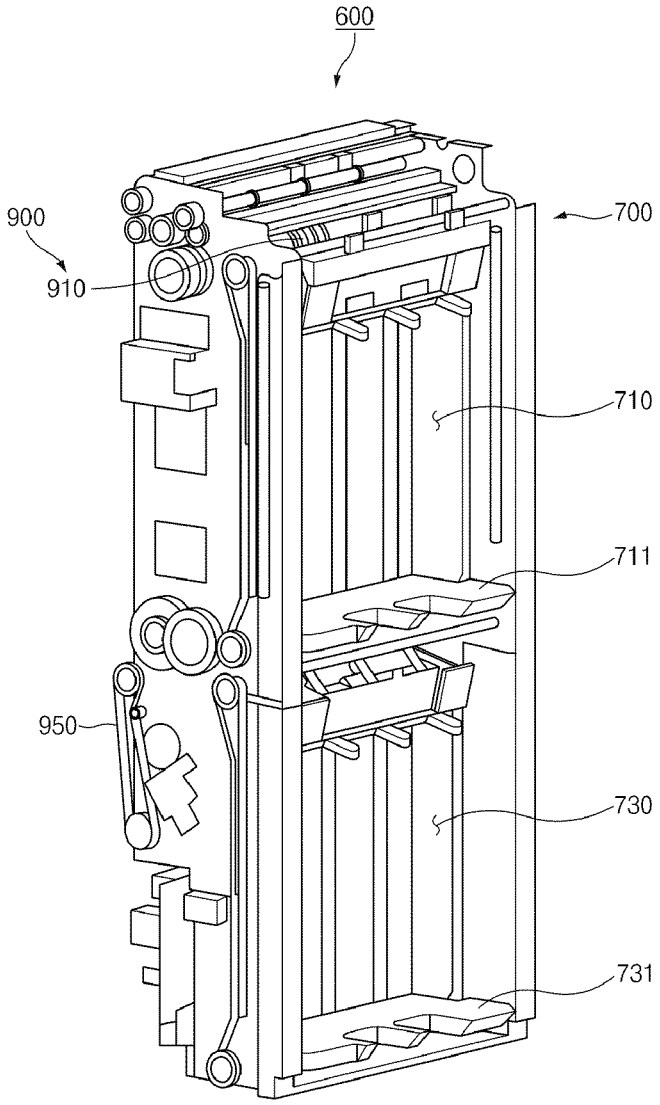
FIG. 20 is a perspective view showing an inside of a media storage device according to Embodiment 5 of the present disclosure.
Figure 21:
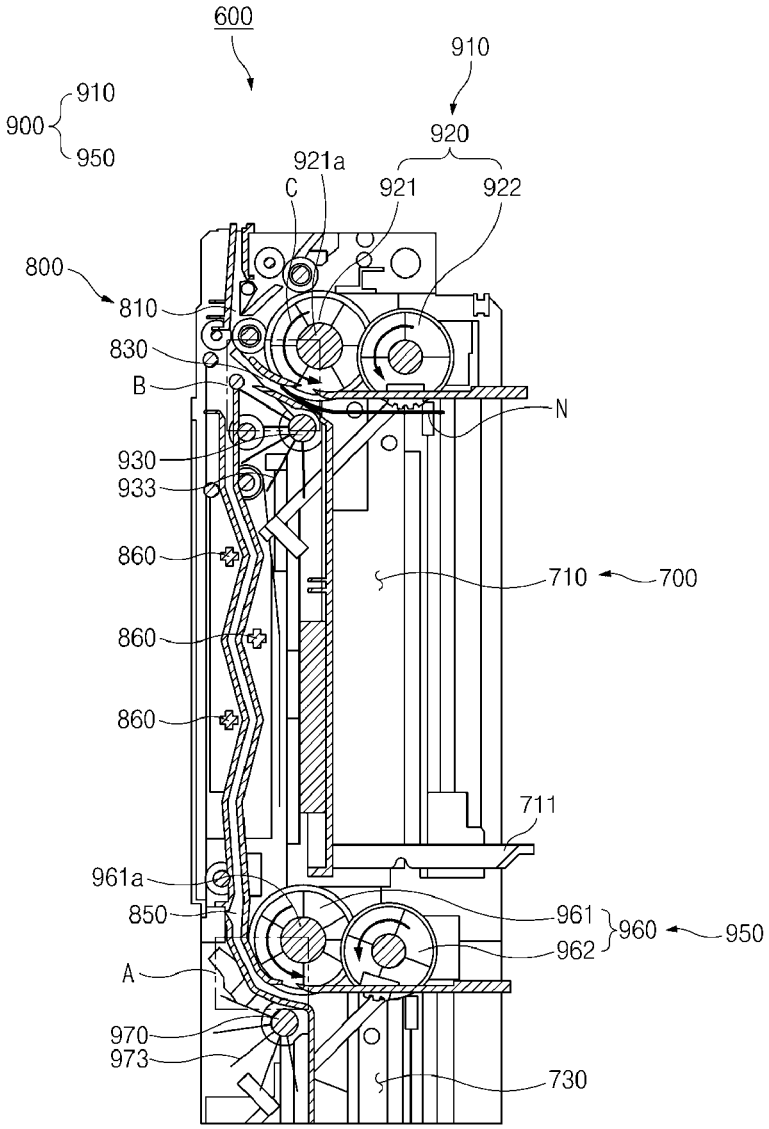
FIG. 21 is a cross-sectional view of FIG. 20.

FIGS. 20 and 21 are perspective views showing a media storage device 600 according to Embodiment 5 of the present disclosure. FIG. 20 is a perspective view showing an inside of the media storage device 600 according to Embodiment 5 of the present disclosure and FIG. 21 is a cross-sectional view of FIG. 20.

Referring to FIGS. 20 and 21, the media storage device 600 according to Embodiment 5 of the present disclosure may include a media stacking part 700, a transfer path unit 800, a transportation unit 900, and a controller.

The media stacking part 700 may include a plurality of media stacking spaces 710 and 730 having media N for deposit and media N for withdrawal stacked therein and separated from each other. Specifically, the media stacking part 700 may include the plurality of media stacking spaces 710 and 730 stacked therein.

Hereinafter, any one of the plurality of media stacking spaces 710 and 730 may be referred to as a first stacking space 710 and one or at least two media stacking spaces other than the first stacking space 710 of the plurality of media stacking spaces 710 and 730 may be referred to as a second stacking space 730.

The transfer path part 800 includes a main transfer path 810, a first transfer path 830, and a second transfer path 850. The main transfer path 810 may be connected to at least one of the media inlet and the media outlet. The media inlet and the media outlet may be formed into one, or may also be formed separately as the illustrated example. The main transfer path 810 may be connected to the media inlet or the media outlet so that the media N withdrawn from the media storage device 600 or the media N deposited in the media storage device 600 may be transported. Further, the transfer path part 800 may further include a driving roller 860 that transports media inserted into the main transfer path 810, the first transfer path 830, and the second transfer path 850.

Further, the main transfer path 810 may be branched into the first transfer path 830 and the second transfer path 850. The first transfer path 830 may be connected to the first stacking space 710 and the second transfer path 850 may be connected to the second stacking space 730. Further, the transfer path part 800 may include a diverter that makes the main transfer path 810 communicate with any one of the first transfer path 830 and the second transfer path 850 to control a transportation direction of media.

A transportation unit 900 may transport the media N so that the media N are inserted into the media stacking part 700 or the media N stacked in the media stacking part 700 are withdrawn. Further, the transportation unit 900 may include a first transportation unit 910 for transporting the media N of the first stacking space 710 and a second transportation unit 950 for transporting the media N of the second stacking space 730.

The first transportation unit 910 includes a first separating member 910 and a first stacking member 930. The first separating member 910 may include, for example, a first feed roller 921, a first gate roller 923, and a first pick-up roller 922, and a frame on which the first feed roller 921, the first gate roller 923, and the first pick-up roller 922 are mounted. The first feed roller 921 may transport the media N that are inserted into or withdrawn from the media stacking space and the first pick-up roller 922 and the first gate roller 923 pick-up and withdraw the media N stored in the media stacking space. For example, as in the illustrated exemplary embodiment, the first transportation unit 910 may further include a driving shaft 921*a* mounted on the frame and connected to the electromagnetic clutch (not shown), and the first feed roller 921 may be rotatably connected to the driving shaft 921*a*. Further, the first pick-up roller 922 may be disposed adjacent to the first feed roller 921 and may be connected to the first feed roller 921 by a connection belt and may be installed to be interlocked with the rotation of the driving shaft 921*a*. Meanwhile, the first gate roller 923 may be provided separately from the first feed roller 921. For example, as described later, the first gate roller 923 may be mounted on the first rotating shaft 931 together with the first stack roller 932. However, the configuration of the first transportation unit 910 applied to the present disclosure is not limited thereto, and therefore may be variously changed as long as the first transportation unit 910 may be implemented by the technical features of the present disclosure.

Further, the second transportation unit 950 may include a second separating member 960 and a second stacking member 970. The second separating member 960 may include, for example, a second feed roller 961, a second gate roller 963, and a second pick-up roller 962. The specific exemplary embodiment of the second transportation unit 950 may adopt the structure of the first transportation unit 910 described above. However, the transportation unit 900 is not limited thereto, and therefore various components for transporting the media N may be applied.

Further, the transportation unit 900 may be provided in each of the plurality of media stacking spaces 710 and 730 to be independently driven. That is, the first transportation unit 910 and the second transportation unit 950 may be driven to independently insert or withdraw the media N into or from the first stacking space 710 and the second stacking space 730, respectively.

Here, the media storage device 600 according to the exemplary embodiment of the present disclosure may further include a driver that supplies power to each component. The driver includes a main driving member (not shown) providing a driving force to the first transportation unit 910, the second transportation unit 950, and the driving roller 860, a first media pusher driving member (not shown) providing a driving force to the first media pusher 711 that supports the media stacked in the first stacking space at the lower portion, and a second media pusher driving member (not shown) providing a driving force to the second media pusher 731 that supports a lower portion of the media stacked in the second stacking space.

Further, the electromagnetic clutch (not shown) controlling the rotation of the driving shaft may be connected to the driving shaft 921*a* connected to the first feed roller 921 and the driving shaft 961*a* connected to the second feed roller 961, respectively, and the main driving member may be connected to the electromagnetic clutch to selectively drive the driving shaft 921*a* of the first feed roller 921 and the driving shaft 961*a* of the second feed roller 961. At this time, the first rotating shaft 931 to which the first gate roller 923 is connected and the second rotating shaft 971 to which the second gate roller 963 is connected may be supplied with power from the main driving member to be rotated together. Accordingly, the media storage device 600 according to the present disclosure may include the plurality of media stacking spaces 710 and 730 that are separated from each other, such that the media N of various denominations may be stacked and stored in one media storage device 600. Further, the stacking and the separating may be independently performed in the in the plurality of media stacking spaces 710 and 730, such that the media storage device 600 may be stably driven.

However, if the plurality of media stacking spaces 710 and 730 are formed as described above, when deposit or withdrawal is performed in the first stacking space 710, the media need not be inserted or withdrawn in the second stacking space 730, and the insertion or withdrawal into or from the first stacking space 710 need not be hindered.

Accordingly, the controller controls the transportation unit 900 so that when the deposit or withdrawal is made in the first stacking space 710, the components and the operation of the components included in the second stacking space 730 may not interfere with the operation of the deposit and withdrawal of the first stacking space 710.

More specifically, when the withdrawal of the media stacked in the first stacking space 710 or the deposit of the media in the first stacking space 710 is requested, if it is sensed that the media N are present on the second transfer path 850, the controller may control the second transportation unit 950 so that the media N sensed in the second transfer path 850 return to the second stacking space 730 before the media of the first stacking space 710 is withdrawn or deposited.

That is, if the withdrawal or deposit of the media stacked in the first stacking space 710 of the plurality of media stacking spaces 710 and 730 is requested according to the user's selection, the controller may sense whether the media N are present on the second transfer path 850 connected to the second stacking space 730 and if it is determined that the media N are present on the second transfer path 850, the controller may operate the second transportation unit 950 to return the sensed media N from the second transfer path 850 to the second stacking space 730.

Accordingly, the media storage device 600 according to the present disclosure removes the media N present on the second transfer path 850 connected to the second stacking space 730 in advance when the deposit or withdrawal operation is performed in the first stacking space 710 not to hinder the deposit or withdrawal operation in the first stacking space 710. Accordingly, the media storage device 600 prevent the failure arising due to the hindrance of the deposit and withdrawal in advance, thereby smoothly performing the deposit and withdrawal in the plurality of media stacking spaces 710 and 730.

Hereinafter, the control of the above-described controller will be described by being divided into the case where the withdrawal from the first stacking space 710 is requested and the case where the deposit in the first stacking space 710 is requested.

First, the case in which the withdrawal from the first stacking space 710 is requested will be described with reference to FIGS. 21 to 26.

Figure 22:
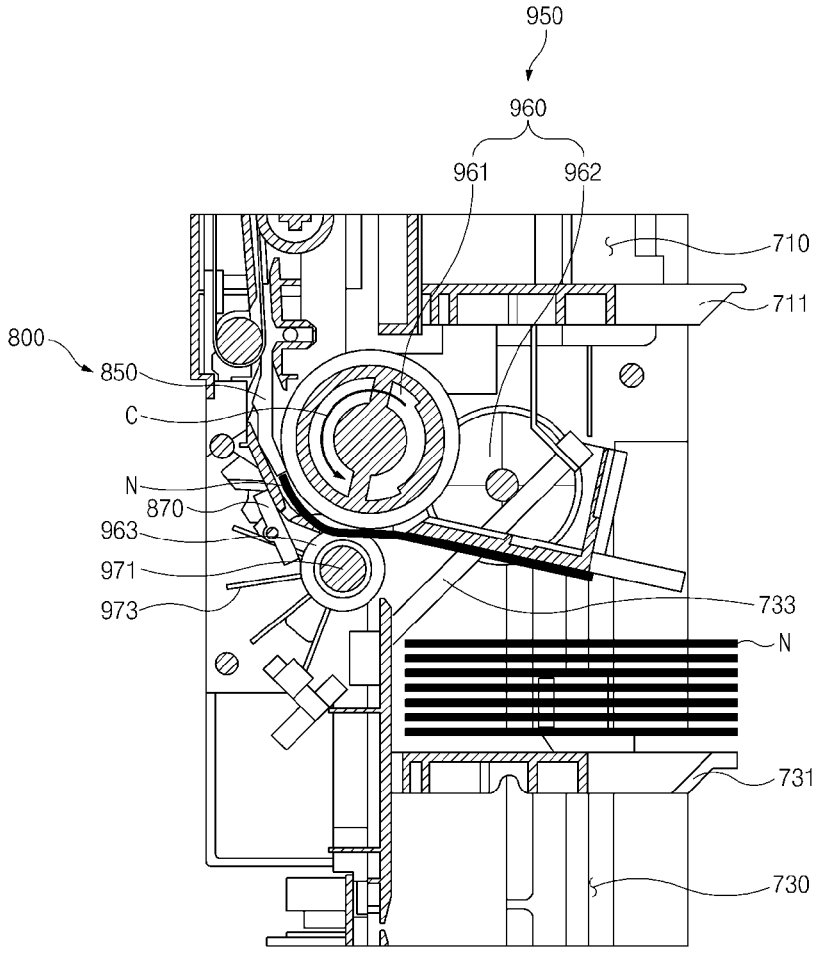
FIG. 22 is a partially enlarged cross-sectional view of part A of FIG. 21.
Figure 23:
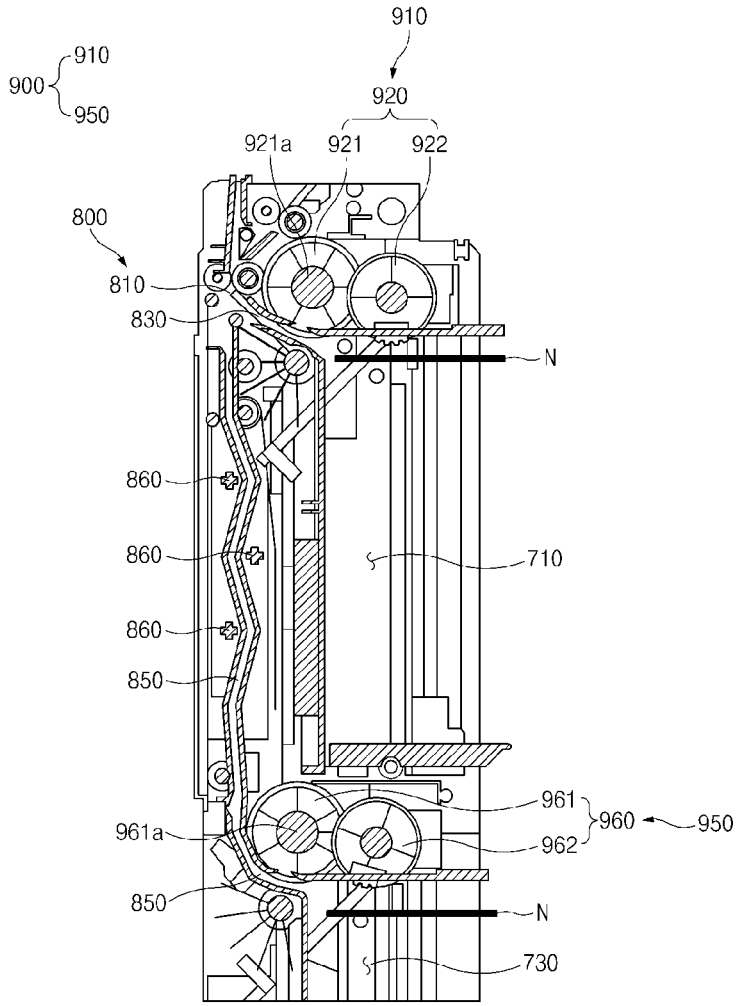
FIG. 23 is a cross-sectional view showing a state after media are transported to a second stacking space.

The exemplary embodiment shown in FIGS. 21 to 23 shows an operation of allowing the controller to sense the second transfer path 850 and return the media N to the second stacking space 730. FIG. 21 is a cross-sectional view of FIG. 20, FIG. 22 is a partially enlarged cross-sectional view of part A of FIG. 21, and FIG. 23 is a cross-sectional view showing a state after the media N are transported to the second stacking space 730.

Referring to FIGS. 21 to 23, the transfer path part 800 may include a feed sensor 870 provided on the second transfer path 850. The feed sensor 870 may sense whether the media N are present on the second transfer path 850. The feed sensor 870 may be applied independent of the sensing manner or the mounting position as long as it may be disposed adjacent to the second transfer path 850 to sense whether the media enter the second transmission path 850 and are present on the second transmission path 850.

Further, if the feed sensor 870 senses that the media N are present on the second transfer path 850, the controller may operate the second transportation unit 950 to transport the media N to the second stacking space 730.

More specifically, the second transportation unit 950 may rotate in direction C shown in FIGS. 21 and 22 under the control of the controller to transport the media N sensed in the second transfer path 850 to the second stacking space 730 (see FIG. 23). Therefore, the media N on the second transfer path 850 may be removed before the media N are withdrawn from the first stacking space 710.

Figure 24:
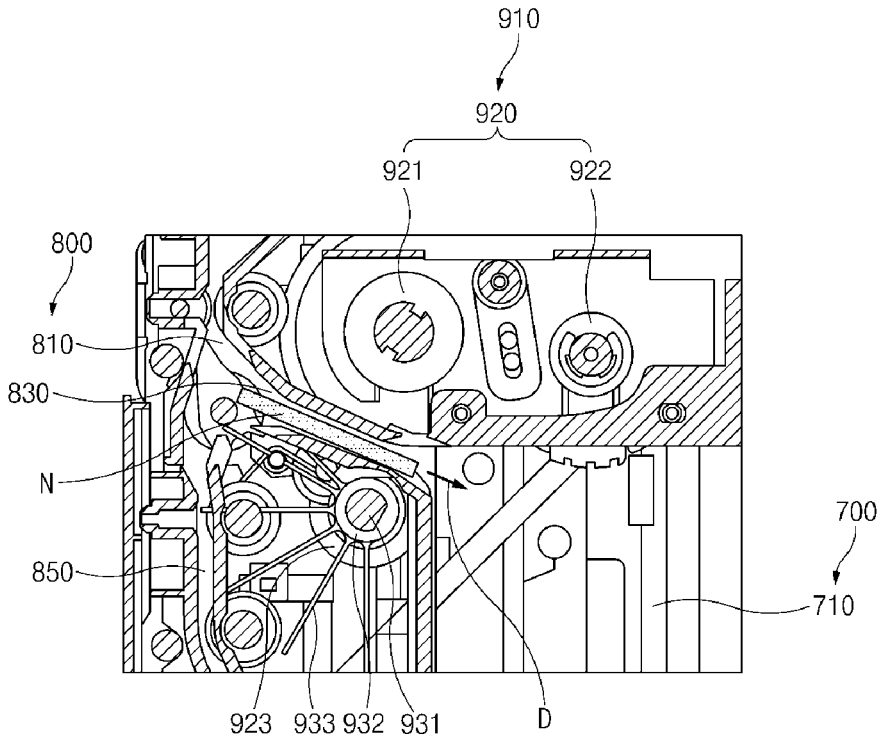
FIG. 24 is a sectional view showing a state in which a first stacking member is mounted.
Figure 25:
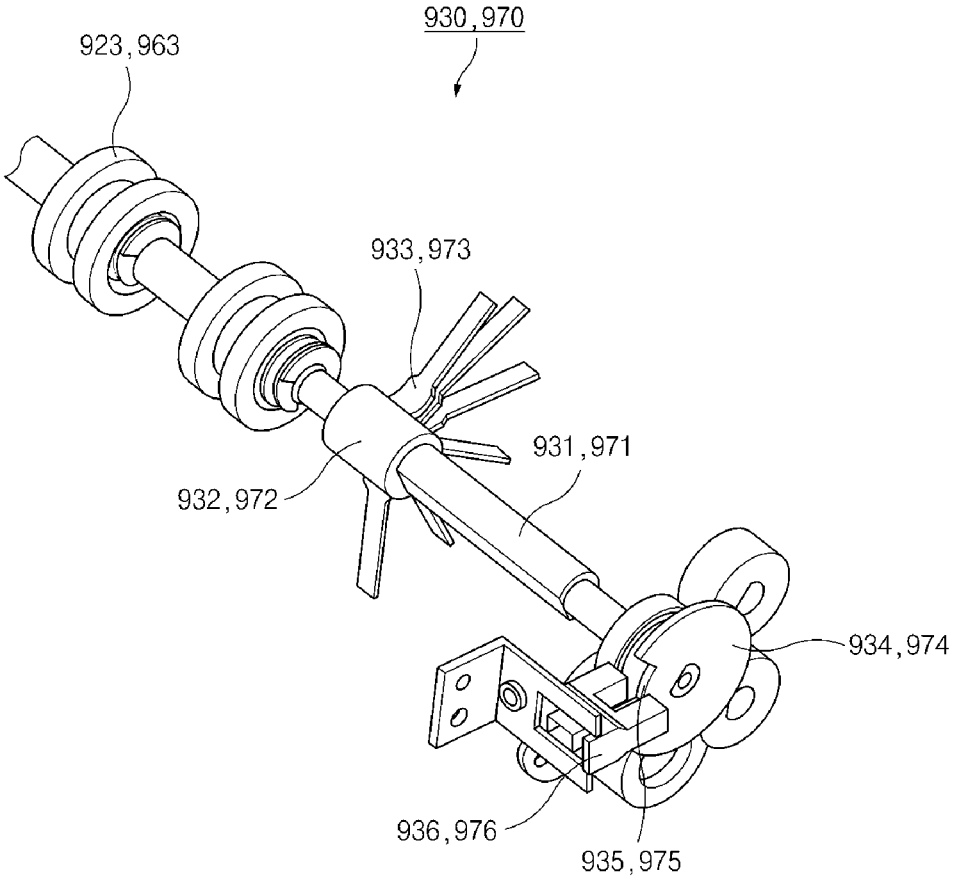
FIG. 25 is a perspective view showing the first stacking member and a second stacking member.

Meanwhile, referring to FIGS. 24 and 25, the first transportation unit 910 may include a first stacking member 930 that inserts the media N entering the first transfer path 830 into the first stacking space 710. FIG. 24 is a cross-sectional view showing a state in which a first stacking member is mounted and FIG. 25 is a perspective view showing the first stacking member.

The first stacking member 930 may include a first rotating shaft 931, a first stack roller 932, and a first stack wing 933. The first rotating shaft 931 may be rotated by being supplied with the driving force of the driver and the first stack roller 932 may be mounted on the first rotating shaft 931 and rotated depending on the rotation of the first rotating shaft 931. Specifically, if the first stack roller 932 is rotated in a direction in which the first rotating shaft 931 is inserted (direction in which the media are inserted into the first stacking space 710), the first stack roller 932 may be rotated together with the first rotating shaft 931 and the first rotating shaft 931 stops upon the withdrawal and thus the first stack roller 932 may be provided to keep the stop state.

Here, the plurality of first stack wings 933 may be disposed on a part of an outer circumferential surface of the first stack roller 932 while being spaced apart from each other and may contact the inserted media to stack the media N in the first stacking space 710.

As described above, the first stacking member 930 serves to stack the media N in the stacking space (see direction D in FIG. 24) and when the media N are withdrawn from the first stacking space 710, if the first stack wing 933 is positioned on the first transfer path 830, there may arise a problem that the transportation of the withdrawn media is not hindered.

Accordingly, when the withdrawal of the media stacked in the first stacking space 710 is requested, if the first stack wing 933 is sensed to be positioned on the first transfer path 830, the controller according to the present disclosure may rotate the first rotating shaft 931 to control the first stacking member 930 so that the first stack wing 933 is avoided from the first transfer path 830.

Specifically, the first stack wing 933 may be formed on a part of the outer circumferential surface of the first stack roller 932 at a predetermined interval, and if the first stack wing 933 is sensed to be positioned on the first transmission path 830, the controller may rotate the first rotating shaft 931 so that the first stack wing 933 may be disposed at a position at which the first transfer path 830 is hindered. Accordingly, it is possible to smooth the transportation of the media when the media N are withdrawn from the first stacking space 710.

More specifically, the first stacking member 930 may include a first rotating body 934 and a first wing position sensor 936. The first rotating body 934 may be rotated depending on rotation of the first rotating shaft 931 while being fixed to the first rotating shaft 931 and may be formed in a disc shape. The first rotating body 934 may include a first through hole 935 by being partially cut.

Further, the first wing position sensor 936 senses a rotation angle of the first rotating body 934 to sense the position of the first stack wing 933. Specifically, the first wing position sensor 936 senses the position of the first through hole 935 to sense the position of the first stack wing 933, thereby sensing whether the first stack wing 933 is positioned on the first transfer path 830.

Thereafter, the controller may control the rotation of the first rotating shaft 931 based on the position of the first stack wing 933 sensed by the first wing position sensor 936. For example, when the first wing position sensor 936 senses the position of the first through hole 935, in the case where the first stack wing 933 is set to be in a position where the first stack wing 933 is not positioned on the first transfer path 830, if the first wing position sensor 936 does not sense the first through hole 935, the controller rotates the first rotating shaft 931 so that the first stack wing 933 is not positioned on the first transfer path 830.

At this time, when the withdrawal of the media from the first stacking space 710 is requested, after the media N of the second transfer path 850 return to the second stacking space 730 and thus it is sensed that the media N are not present on the second transfer path 850, the controller may rotate the first rotating shaft 931 to control the first stacking member 930 so that the first stack wing 933 is avoided from the first transfer path 830.

Figure 26:
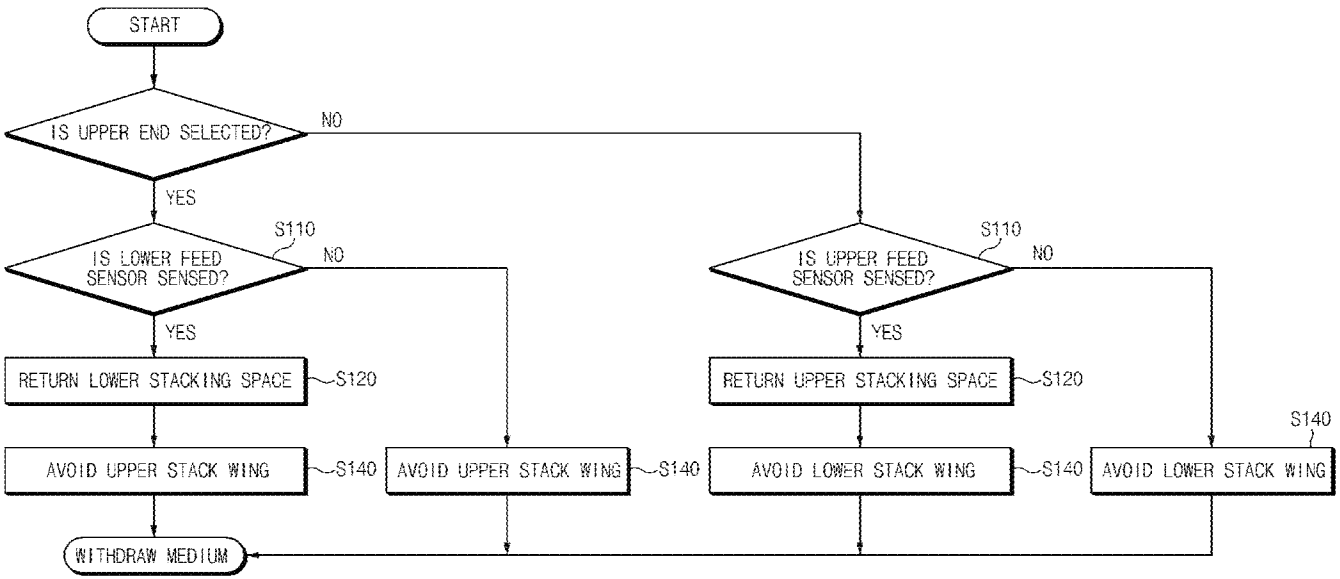
FIG. 26 is a block diagram for explaining a method for controlling a financial device upon withdrawal.

Hereinafter, a method for controlling a financial device for withdrawing the media N stacked in the first stacking space 710 will be described with reference to the block diagram shown in FIG. 26. For convenience of explanation, FIG. 26 shows that the media stacking part 700 includes a two-stage stacking space of upper and lower stages. However, as described above, the stacking space selected by the user for the withdrawal is the first stacking space 710 and the unselected stacking space is the second stacking space 730.

Like the exemplary embodiment shown in FIG. 26, the method for controlling a financial device when the media are withdrawn may include a second transfer path sensing step (S110), a second transfer path returning step (S120), a first stack wing position sensing step (S130), a first stack wing avoiding step (S140), and a media withdrawing step.

In the second transfer path sensing step (S110), if the withdrawal of the media stacked in the first stacking space 710, which is any one of the two-stage media stacking spaces, is requested according to the user's selection, it may be sensed whether the media N are present on the second transfer path 850 connected to the second stacking space 730 that is the other thereof.

In the second transfer path returning step (S120), if the media N are sensed in the second transfer path sensing step (S110), the sensed media (N) may return to the second stacking space 730 from the second transfer path 850. The detailed configuration for transporting the media N to the second stacking space 730 is as described above. At this time, if the media N are not sensed on the second transfer path 850, the first stack wing position sensing step (S130) may be performed immediately.

In the first stack wing position sensing step S130, the position of the first stack wing 933 provided in the first stacking member 930 that inserts the media N into the first stacking space 710 may be sensed.

In the first stack wing avoiding step (S140), if it is sensed that the first stack wing 933 is positioned on the first transmission path 830 connected to the first stacking space 710 in the first stack wing position sensing step (S130), the first stacking member 930 may be driven so that the first stack wing 933 is avoided from the first transfer path 830.

After the second transfer path returning step S120 and the first stack wing avoiding step S140 are performed, the media N stacked in the first stacking space 710 may be withdrawn in the media withdrawing step.

Figure 27:
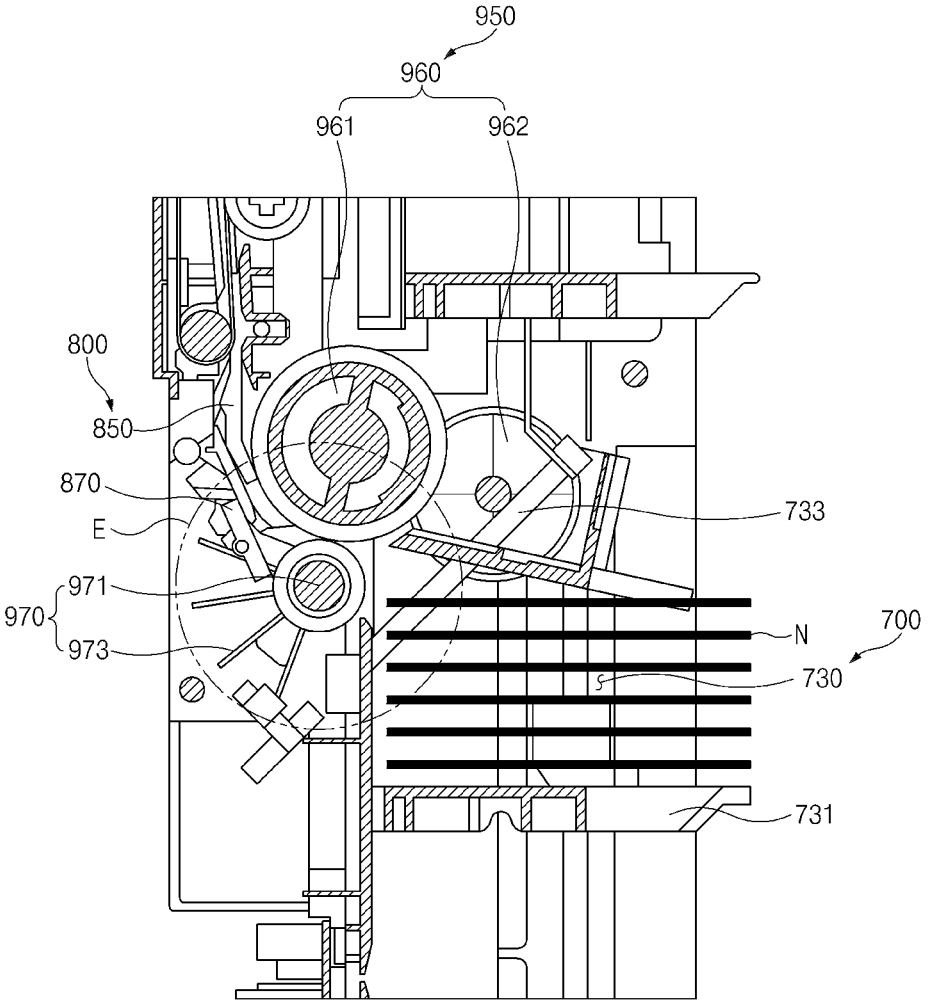
FIG. 27 is a cross-sectional view showing a state in which a media pusher or media are sensed in a rotation region of a stack wing.
Figure 28:
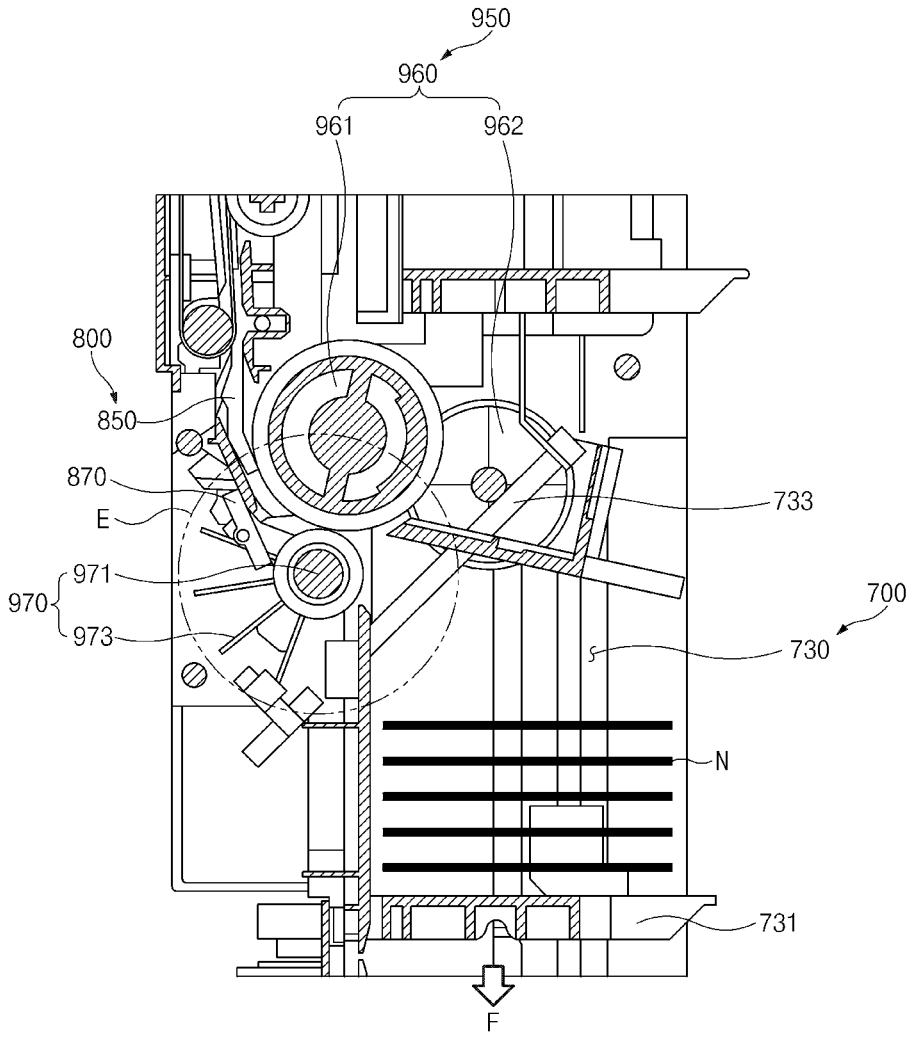
FIG. 28 is a cross-sectional view showing a state in which the media pusher moves downward in FIG. 27.
Figure 29:
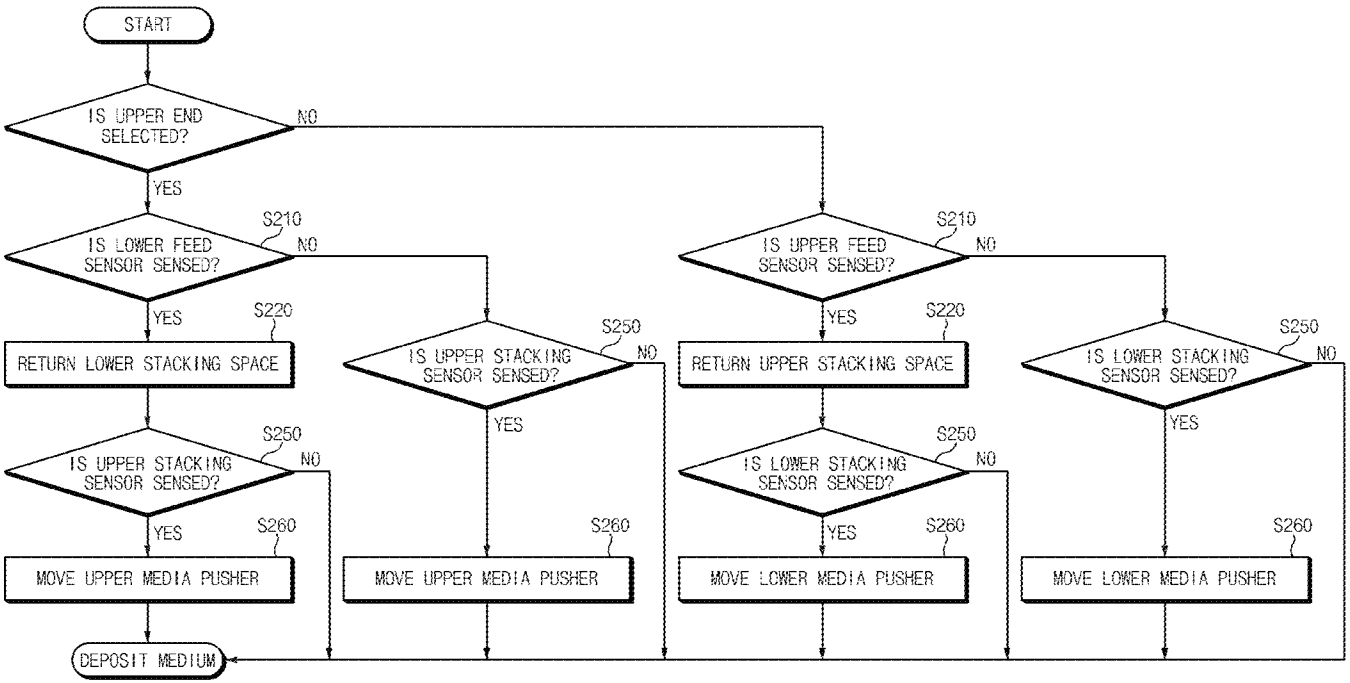
FIG. 29 is a block diagram for explaining a method for controlling a financial device upon deposit.

Next, the case where the deposit in the first stacking space 710 is requested will be described with reference to FIGS. 21 to 23 and FIGS. 27 to 29. FIG. 27 is a cross-sectional view showing a state in which a media pusher or media N are sensed in a rotation region of a stack wing, FIG. 28 is a cross-sectional view showing a state in which the media pusher moves downward in FIG. 27, and FIG. 29 is a block diagram for explaining a method for controlling a financial device upon deposit. However, in the description of the deposit operation in the first stacking space 710 described below, a detailed description of a part overlapping with the description of the withdrawal operation will be omitted.

First, when the user requests the deposit of the media in the first stacking space 710, if it is sensed that the media N are on the second transfer path 850 is sensed, the controller may control the second transportation unit 950 to return the media N sensed in the second transfer path 850 to the second stacking space 730 before the media N of the first stacking space 710 is deposited. The configuration for sensing the presence of the media N on the second transfer path 850 and the configuration for transporting the media N to the second stacking space 730 are the same as those described in the above-described withdrawal operation.

Further, referring to FIGS. 25, 27, and 28, the second transportation unit 950 may include the second stacking member 970 that inserts the media N entering the second transfer path 850 into the second stacking space 730. The second stacking member 970 may include a second rotating shaft 971, a second stack roller 972, and a second stack wing 973. The second stack roller 972 may be rotated while being mounted on the second rotating shaft 971 and the plurality of second stack wings 973 may be disposed at a part of an outer circumferential surface of the second stack roller 972 while being spaced apart from each other (see FIG. 25). Further, the second stacking member 970 may further include a second rotating body 974, a second through hole 975, and a second wing position sensor 976.

Further, referring to FIG. 27, the media stacking part 700 may further include the second media pusher 731 and the second stacking sensor 733.

The second media pusher 731 is provided to be vertically movable in the second stacking space 730 and may support the lower surface of the media stacked in the second stacking space 730. That is, the media N may be stacked on the upper surface of the second media pusher 731.

The second stacking sensor 733 may sense whether the second media pusher 731 or the media N stacked in the second media pusher 731 are present in the rotation region (see region E of FIGS. 27 and 28) depending on the rotation of the second stack wing 973. Here, the rotation region depending on the rotation of the second stack wing 973 refers to a region in a virtual circle drawn by a tip of the second stack wing 973 when the second stack wing 973 is rotated. If the second media pusher 731 or the media N are in the rotation region depending on the rotation of the second stack wing 973, the rotation of the second stack wing 973 is hindered, such that the failure may arise when the second stack roller 972 is rotated. (see FIG. 27). As described above, the first rotating shaft 931 and the second rotating shaft 971 are provided to be rotated together, and therefore the first gate roller 932 and the second gate roller 972 may be driven together. Therefore, the second stack roller 972 and the second stack wing 973 provided in the second stacking space 730 are rotated together during the deposit operation in the first stacking space 710, and therefore there is a need to control the position of the second media pusher 731 of the second stacking space 730.

Therefore, when the deposit of the media in the first stacking space 710 is requested, if it is sensed that the second media pusher 731 or the media N stacked in the second media pusher 731 are present in the rotation region of the second stack wing 973, the controller may move the second media pusher 731 downwardly so that the second media pusher 731 or the media N stacked in the second media pusher 731 are avoided from the rotation region of the second stack wing 973 (see direction F in FIG. 28).

If the second stacking sensor 733 senses that the media or the second media pusher 731 is not present in the rotation region depending on the rotation of the second stack wing 973, the second media pusher 731 stops. In this way, the position of the second media pusher 731 is adjusted so that the second stack wing 973 does not contact the media or the media pusher when the second stack wing 973 is rotated, such that the second stack wing 973 may be smoothly rotated.

Further, the position of the first media pusher 711 provided in the first stacking space 710 may also be adjusted like the second media pusher 731 described above.

Specifically, the media stacking part 700 may further include the first media pusher 711 and the first stacking sensor 713.

The first media pusher 711 is provided to be vertically movable in the first stacking space 710 and may support the lower surface of the media stacked in the first stacking space 710. The first stacking sensor 713 may sense whether or not the first media pusher 711 or the media N stacked in the first media pusher 711 are present in the rotation region depending on the rotation of the first stack wing 933.

Further, when the deposit of the media in the first stacking space 710 is requested, if it is sensed that the first media pusher 711 or the media N stacked in the first media pusher 711 are present in the rotation region of the first stack wing 933, the controller may move the first media pusher 711 downwardly so that the first media pusher 711 or the media N stacked in the first media pusher 711 are avoided from the rotation region of the first stack wing 933.

If the first stacking sensor 713 senses that the media or the first media pusher 711 is not present in the rotation region depending on the rotation of the first stack wing 933, the first media pusher 711 stops. In this way, the position of the first media pusher 711 is adjusted so that the first stack wing 933 does not contact the media or the media pusher when the first stack wing 933 is rotated, such that the first stack wing 933 may be smoothly rotated. However, the adjusted position of the first media pusher 711 may be a position raised by a predetermined height from the position where the first media pusher 711 or the media N stacked in the first media pusher 711 are avoided from the rotation region of the first stack wing 933. That is, when the deposit of the media in to the first stacking space 710 is requested, the height of the first media pusher 711 for deposit needs to be set at a proper position where the inserted media N drop so that the inserted media N are aligned to be easily stacked and therefore may be set at a position where it is higher than the position avoided from the rotation region E of the first stack wing 933.

At this time, when the deposit of the media in the first stacking space 710 is requested, after it is sensed that the media N of the second transfer path 850 return to the second stacking space 730 and thus the media N are not present on the second transfer path 850 and the second media pusher 731 or the media N stacked in the second media pusher 731 are sensed as being avoided from the rotating region of the second stack wing 973, the controller may move the first media pusher 711 downwardly so that the first media pusher 711 or the media N stacked in the first media pusher 711 may be avoided from the rotation region of the first stack wing 933.

Hereinafter, a method for controlling a financial device for depositing the media N stacked in the first stacking space 710 will be described with reference to the block diagram shown in FIG. 29. For convenience of explanation, FIG. 29 shows that the media stacking part 700 includes a two-stage stacking space of upper and lower stages. However, as described above, the stacking space selected by the user for deposit is the first stacking space 710 and the unselected stacking space is the second stacking space 730.

Like the exemplary embodiment shown in FIG. 29, the method for controlling a financial device when the media are deposited may include a second transfer path sensing step (S210), a second stacking space returning step (S220), a first stack wing rotation region sensing step (S250), a first media pusher moving step (S260), and a media depositing step.

In the second transfer path sensing step (S210), if the deposit of the media in the first stacking space 710, which is any one of the two-stage media stacking spaces, is requested according to the user's selection, it may be sensed whether the media N are present on the second transfer path 850 connected to the second transfer path 730 that is the other thereof.

In the second stacking space returning step (S220), if the media N are sensed in the second transfer path sensing step (S210), the sensed media (N) may return from the second transfer path 850 to the second stacking space 730.

In the first stack wing rotation region sensing step S250, it may be sensed whether the first media pusher 711 supporting the media N stacked in the first stacking space 710 or the media N stacked in the first media pusher 711 are present in the rotation region of the first stack wing 933 provided in the first stacking member 930 that inserts the media N into the first stacking space 710.

In the first media pusher moving step S260, if the first media pusher 711 or the media N stacked in the first media pusher 711 are sensed in the rotation region of the first stack wing 933 in the first stack wing rotation region sensing step (S250), the first media pusher 711 may move so that the first media pusher 711 or the media N are avoided from the rotation region of the first stack wing 933.

After both of the above-described second stacking space returning step (S220) and the first media pusher moving step (S260) are performed, the media N may be deposited in the first stacking space 710 in the media depositing step.

Therefore, according to the media storage device, the financial device including the same, and the method for controlling the same according to the present disclosure, when the deposit or withdrawal operation is performed in the first stacking space, the parts or the media of the first and second stacking spaces do not hinder the deposit and withdrawal operation of the first stacking space, thereby smoothly performing the deposit and withdrawal operation in the plurality of media stacking spaces.

Meanwhile, the method for controlling a financial device may include a transfer path sensing step, a transfer path returning step, a stack wing position sensing step, a stack wing avoiding step, a media withdrawing step.

A transfer path sensing step may sense whether media are present on the first transfer path connected to the first stacking space and the second transfer path connected to the second stacking space if the withdrawal of the media stacked in at least one of the first stacking space and the second stacking space is requested.

A transfer path returning step may return the sensed media from the first transfer path to the first stacking space or from the second transfer path to the second stacking space if the media are sensed in the transfer path sensing step.

A stack wing position sensing step may sense the position of the first stack wing included in the first stacking member that inserts the media into the first stacking space or sensing the position of the second stack wing included in the second stacking member that inserts the media into the second stacking space.

A stack wing avoiding step may drive the first stacking member or the second stacking member so that the first stack wing or the second stack wing is avoided from the first transfer path or the second transfer path if it is sensed that the first stack wing is positioned on the first transfer path connected to the first stacking space or if it is sensed that the second stack wing is positioned on the second transfer path connected to the second stacking space in the stack wing position sensing step.

And A media withdrawing step may withdraw the media stacked in at least any one of the first stacking space and the second stacking space.

In this way, even if the withdrawal of the media to any one of the first and second stacking spaces is requested, the withdrawal preparation for both the first stacking space and the second stacking space is completed, such that the quick withdrawal may be achieved.

Meanwhile, the method for controlling a financial device may include a transfer path sensing step, a stacking space returning step, a stack wing rotation region sensing step, a media pusher moving step, a media depositing step.

A transfer path sensing step may sense whether media are present on the first transfer path connected to the first stacking space and the second transfer path connected to the second stacking space if the deposit of the media in at least one of the first stacking space and the second stacking space is requested.

A second stacking space returning step may return the sensed media from the first transfer path to the first stacking space or from the second transfer path to the second stacking space if the media are sensed in the transfer path sensing step.

A stack wing rotation region sensing step may sense whether the first media pusher supporting the media stacked in the first stacking space or the media stacked in the first media pusher are present in the rotation region of the first stack wing included in the first stacking member that inserts the media into the first stacking space or the second media pusher supporting the media stacked in the second stacking space or the media stacked in the second media pusher are present in the rotation region of the second stack wing included in the second stacking member that inserts the media into the second stacking space.

A media pusher moving step may move the first media pusher or the second media pusher so that the first media pusher and the second media pusher and the media are avoided from the rotation region of the first stack wing or the second stack wing if the first media pusher or the media stacked in the first media pusher are sensed in the rotation region of the first stack wing or the second media pusher or the media stacked in the second media pusher are sensed in the rotation region of the second stack wing.

And A media depositing step may deposit the media in at least any one of the first stacking space and the second stacking space.

In this way, even if the deposit of the media in any one of the first and second stacking spaces is requested, the deposit preparation for both the first stacking space and the second stacking space is completed, such that the quick deposit may be achieved.

According to the present disclosure, the media storage module can accommodate various sizes of media by including the plurality of stacking spaces having different sizes in one module.

Further, according to the present disclosure, the financial device can use the media storage module including the plurality of storing parts as the temporary stacking module to prevent the errors such as the jam phenomenon from occurring during the temporary stacking of media.

Further, according to the present disclosure, the financial device can use the media storage module including the plurality of storing parts in performing the ready-money verification to prevent the occurrence of errors and shorten the ready-money verification time.

Further, according to the present disclosure, the limited space within the media storage device including the plurality of media stacking spaces can be efficiently used to improve the transportation quality of media and increase the number of media storage devices mounted inside the financial device.

Further, according to the media storage device, the financial device including the same, and the method for controlling the same according to the present disclosure, when the deposit or withdrawal operation is performed in the first stacking space, the parts or the media of the first and second stacking spaces do not hinder the deposit and withdrawal operation of the first stacking space, thereby smoothly performing the deposit and withdrawal operation in the plurality of media stacking spaces.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A financial device, comprising:

a multi-media storage module including a first storage part having a first stacking space in which media are stacked and a second storage part disposed under the first storage part and having a second stacking space in which media are stacked;

a transfer path part including a main transfer path connected to an inlet/outlet through which the media are inserted to and/or withdrawn from the multi-media storage module, a first transfer path branched from the main transfer path and connected to the first stacking space, and a second transfer path branched from the main transfer path and connected to the second stacking space;

at least one feed sensor sensing whether the media are present on the transfer path part;

a transportation unit transporting the media to the first stacking space or the second stacking space; and a controller controlling the transportation unit, wherein when the withdrawal of the media stacked in the first stacking space or the deposit of the media in the first stacking space is requested, if it is sensed that the media are present on the second transfer path, the controller controls the transportation unit so that the media sensed in the second transfer path return to the second stacking space before the media is withdrawn or deposited to and in the first stacking space, wherein the first storage part includes a first damper for aligning and stacking the media inserted into the first stacking space, wherein the second storage part includes a second damper for aligning and stacking the media inserted into the second stacking space, wherein a distance between a front surface of the first storage part and the first damper is different from a distance between a front surface of the second storage part and the second damper for providing the first stacking space and the second stacking space at different sizes, wherein the transportation unit includes:

a main transportation unit for transporting the media on the transfer path part;

a first transportation unit stacking the media in the first stacking space and withdrawing the media stacked in the first stacking space to the first transfer path; and a second transportation unit stacking the media in the second stacking space and withdrawing the media stacked in the second stacking space to the second transfer path, wherein the first transportation unit includes a first stacking member including a first rotating shaft, a first stack roller rotated while being mounted on the first rotating shaft, and a plurality of first stack wings disposed to be spaced apart from each other and disposed on a part of an outer circumference surface of the first stack roller to insert the media entering the first transfer path into the first stacking space, wherein the second transportation unit includes a second stacking member including a second rotating shaft, a second stack roller rotated while being mounted on the second rotating shaft, and a plurality of second stack wings disposed to be spaced apart from each other and disposed on a part of an outer circumference surface of the second stack roller to insert the media entering the second transfer path into the second stacking space, when the withdrawal of the media stacked in the multi-media storage module is requested, if it is sensed that one of the first stack wing and the second stack wing is positioned on the transfer path part, the controller rotates the rotating shaft to which the stack wing positioned on the transfer path part is coupled to control the stack wing positioned on the transfer path part to be avoided from the transfer path part, wherein the multi-media storage module includes a media pusher provided to vertically move in the second stacking space and supporting a lower surface of the media stacked in the second stacking space and a stacking sensor sensing whether the media pusher or the media stacked in the media pusher are present in a rotation region depending on a rotation of the second stack wing, and when the deposit of the media in the first stacking space is requested, if it is sensed that the media pusher or the media stacked in the media pusher are present in the rotation region of the second stack wing, the controller moves the media pusher downwardly so that the media pusher or the media stacked in the media pusher are avoided from the rotation region of the second stack wing.

2. The financial device according to claim 1, further comprising:

a transfer path part including a main transfer path connected to an inlet/outlet through which the media are inserted to and/or withdrawn from the multi-media storage module, a first transfer path branched from the main transfer path and connected to the first stacking space, and a second transfer path branched from the main transfer path, connected to the second stacking space, and disposed on one side surface of the first stacking space; and a driver including a plurality of driving members that provide a driving force for stacking the media in the first stacking space and the second stacking space and disposed on one side surface of the second stacking space, wherein the first stacking space and the second stacking space are disposed in a vertical direction and are disposed so that at least a part thereof overlaps each other.

3. The financial device according to claim 2, further comprising:

a first transportation unit transporting the media to the first stacking space and withdrawing the media stacked in the first stacking space; and a second transportation unit transporting the media to the second stacking space and withdrawing the media stacked in the second stacking space, wherein the driver includes:

a main driving member providing a driving force to the first transportation unit and the second transportation unit;

a first support plate driving member providing a driving force to a first support plate supporting a lower portion of the media stacked in the first stacking space; and a second support plate driving member providing a driving force to a second support plate supporting a lower portion of the media stacked in the second stacking space.

4. The financial device according to claim 3, further comprising:

a power transmission unit for transmitting the power of the driver to the first transportation unit and the second transportation unit, wherein the power transmission unit includes:

a first clutch connected to the first transportation unit to intermittently transmit the driving force of the main driving member to rotate the first transportation unit; and a second clutch connected to the second transportation unit to intermittently transmit the driving force of the main driving member to rotate the second transportation unit.

5. The financial device according to claim 1, further comprising:

a transportation module transporting the media;

a media storage part including the multi-media storage module that stacks the media transported by the transportation module or withdraws the stacked media to the transportation module;

a discrimination module identifying the media; and a controller controlling the transportation of the media, wherein the media transported by the transportation module are transported to any one of the first stacking space and the second stacking space based on the size of an identified medium by the discrimination module.

6. The financial device according to claim 5, wherein the media storage part further includes a second media storage module in which media are stacked, the controller performs a control to perform a collection transportation of withdrawing at least some of the media stacked in the second media storage module to the transportation module and transporting the media withdrawn from the second media storage module to the multi-media storage module and a verification transportation of withdrawing the media transported to the multi-media storage module by the collection transportation to the transportation module and transporting the media withdrawn from the multi-media storage module to the second media storage module through the discrimination module, when a ready-money verification checking whether the total amount of media stacked in the second media storage module is equal to the total amount of the media electrically stored in the financial device on the second media storage module is required, and the media transported to the multi-media storage module are transported to any one of the first stacking space and the second stacking space based on a size of the media in the case of the collection transportation.

7. The financial device according to claim 1, wherein the first and second stacking members include a disc-shaped first rotating body fixed to the first rotating shaft and rotated depending on a rotation of the first rotating shaft and a first wing position sensor sensing a rotation angle of the first rotating body to sense a position of the first stack wing, and the controller controls the rotation of the first rotating shaft based on the position of the first stack wing sensed by the first wing position sensor.

8. The financial device according to claim 1, wherein when the withdrawal of the media stacked in the first stacking space is requested, after the media on the second transfer path returns to the second stacking space and thus it is sensed that the media are not present on the second transfer path, the controller rotates the first rotating shaft to control the first stacking member so that the first stack wing is avoided from the first transfer path.

9. A method for controlling a financial device including a multi-media storage module including a first storage part having a first stacking space in which media are stacked and a second storage part disposed under the first storage part and having a second stacking space having media stacked therein and having a size different from that of the first stacking space and a second media storage module in which media are stacked, the method comprising:

a transporting step of transporting the media to stack the media in the multi-media storage module or withdraw the media from the multi-media storage module by a transportation module;

an identifying step of identifying the media transported in the transporting step by a discrimination module;

a transfer path sensing step of sensing whether the media are present on a first transfer path connected to the first stacking space and a second transfer path connected to the second stacking space by at least one feed sensor if the deposit of the media to at least any one of the first stacking space and the second stacking space is requested;

a stacking space returning step of returning the sensed media from the first transfer path to the first stacking space or from the second transfer path to the second stacking space by the transportation unit if the media are sensed in the transfer path sensing step;

a stack wing rotation region sensing step of sensing whether a first media pusher supporting the media stacked in the first stacking space or the media stacked in the first media pusher are present in a rotation region of a first stack wing included in a first stack member that inserts the media in the first stacking space by a first stacking sensor or whether a second media pusher supporting the media stacked in the second stacking space or the media stacked in the second media pusher are present in a rotation region of a second stack wing included in a second stacking member that inserts the media in the second stacking space by a second stacking sensor;

a media pusher moving step of moving the first media pusher or the second media pusher by a controller so that the first media pusher and the second media pusher and the media are avoided from the rotation region of the first stack wing or the second stack wing if the first media pusher or the media stacked in the first media pusher are sensed in the rotation region of the first stack wing or the second media pusher or the media stacked in the second media pusher are sensed in the rotation region of the second stack wing, in the stack wing rotation region sensing step;

a stacking step of transporting the media to any one of the first stacking space which is determined by a distance between a front surface formed on a side into which the media of the first storage part are inserted and a first damper and the second stacking space which is determined by a distance between a front surface formed on a side into which the media of the second storage part are inserted and a second damper based on a size of the media identified in the identifying step by a transportation unit, and a media depositing step of depositing the media in at least any one of the first stacking space and the second stacking space by the transportation unit.

10. The method according to claim 9, further comprising:

a transfer path sensing step of sensing whether the media are present on a first transfer path connected to the first stacking space and a second transfer path connected to the second stacking space by at least one feed sensor if the withdrawal of the stacked media to at least any one of the first stacking space and the second stacking space are requested;

a transfer path returning step of returning sensed media from the first transfer path to the first stacking space or from the second transfer path to the second stacking space if the media are sensed in the transfer path sensing step by the transportation unit;

a stack wing position sensing step of sensing a position of a first stack wing included in a first stacking member that inserts the media into the first stacking space by a first wing position sensor or sensing a position of a second stack wing included in a second stacking member that inserts the media into the second stacking space by a second wing position sensor;

a stack wing avoiding step of driving the first stacking member or the second stacking member by a controller so that the first stack wing or the second stack wing is avoided from the first transfer path or the second transfer path if it is sensed in the stack wing position sensing step that the first stack wing is positioned on the first transfer path connected to the first stacking space or the second stack wing is positioned on the second transfer path connected to the second stacking space; and a media withdrawing step of withdrawing the media stacked in at least any one of the first stacking space and the second stacking space by the transportation unit.

* * * * *